US011058920B2

(12) United States Patent
Hwang et al.

(10) Patent No.: US 11,058,920 B2
(45) Date of Patent: Jul. 13, 2021

(54) GOLF BALL HAVING SURFACE DIVIDED BY LINE SEGMENTS OF GREAT CIRCLES AND SMALL CIRCLES

(71) Applicant: VOLVIK INC., Chungcheongbuk-do (KR)

(72) Inventors: In Hong Hwang, Namyangju-si (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

(21) Appl. No.: 16/103,517

(22) Filed: Aug. 14, 2018

(65) Prior Publication Data

US 2019/0038939 A1 Feb. 7, 2019

Related U.S. Application Data

(63) Continuation-in-part of application No. 15/342,389, filed on Nov. 3, 2016, now abandoned.

(30) Foreign Application Priority Data

Apr. 15, 2016 (KR) ..... 10-2016-0046489

(51) Int. Cl.
*A63B 37/12* (2006.01)
*A63B 37/14* (2006.01)
(Continued)

(52) U.S. Cl.
CPC ..... *A63B 37/0006* (2013.01); *A63B 37/002* (2013.01); *A63B 37/0018* (2013.01); *A63B 45/00* (2013.01); *A63B 37/0009* (2013.01)

(58) Field of Classification Search
CPC ..... A63B 37/0006
(Continued)

(56) References Cited

U.S. PATENT DOCUMENTS 4,560,168 A * 12/1985 Aoyama ..... A63B 37/0019 473/379
4,729,567 A * 3/1988 Oka ..... A63B 37/0004 473/384
(Continued)

FOREIGN PATENT DOCUMENTS

KR 960004335 B1 4/1996
KR 100360310 B1 10/2002
(Continued)

OTHER PUBLICATIONS

Hwang, Machine Translation of KR10-2016-0046489, Aug. 10, 2016, KIPO, 27 pages.*
(Continued)

*Primary Examiner* — Eugene L Kim
*Assistant Examiner* — Matthew B Stanczak
(74) *Attorney, Agent, or Firm* — Kilpatrick Townsend & Stockton LLP

(57) ABSTRACT

A surface of a sphere is divided by using not only great circles but also small circles, forming a spherical polyhedron. The spherical polyhedron includes two spherical regular pentagons, each having a center at the pole, ten spherical isosceles triangles near the pole, ten spherical pentagons near the equator, and ten other spherical isosceles triangles near the equator. Compared to a related art, dimples are accurately arranged in spherical polygons. Thus, a dimple area ratio is improved and the number of dimples is appropriately maintained.

19 Claims, 14 Drawing Sheets

(51) Int. Cl.
*A63B 37/00* (2006.01)
*A63B 45/00* (2006.01)

(58) Field of Classification Search
USPC ..... 473/379
See application file for complete search history.

(56) References Cited

U.S. PATENT DOCUMENTS 4,877,252 A * 10/1989 Shaw ..... A63B 37/0018 473/379
5,016,887 A 5/1991 Jonkouski
5,192,078 A * 3/1993 Woo ..... A63B 37/0006 473/379
5,338,039 A 8/1994 Oka et al.
5,377,989 A * 1/1995 Machin ..... A63B 37/0004 40/327
5,566,943 A * 10/1996 Boehm ..... A63B 37/0004 473/378
5,575,477 A 11/1996 Hwang
6,346,054 B1 * 2/2002 Shimosaka ..... A63B 37/0004 473/378
6,450,902 B1 9/2002 Hwang
6,835,794 B2 * 12/2004 Wu ..... A63B 37/0003 473/374
6,908,403 B1 6/2005 Hwang
2013/0288827 A1 * 10/2013 Hwang ..... A63B 37/0003 473/379
2016/0317872 A1 * 11/2016 Hwang ..... A63B 37/0004

FOREIGN PATENT DOCUMENTS

KR 100506196 B1 7/2005
KR 101309993 B1 9/2013
KR 1020160046489 B1 4/2016

OTHER PUBLICATIONS

U.S. Appl. No. 15/342,389 received a Non Final Office action, dated Dec. 4, 2017, 15 pages.
U.S. Appl. No. 15/342,389 received a Final Office Action, dated May 15, 2018, 15 pages.

* cited by examiner

GOLF BALL HAVING SURFACE DIVIDED BY LINE SEGMENTS OF GREAT CIRCLES AND SMALL CIRCLES

CROSS-REFERENCE TO RELATED APPLICATION

This application is a continuation-in-part of U.S. application Ser. No. 15/342,389, filed Nov. 3, 2016, which claims the benefit of Korean Patent Application No. 10-2016-0046489, filed on Apr. 15, 2016 in the Korean Intellectual Property Office, the disclosures of which are incorporated herein in their entireties by reference.

BACKGROUND

1. Field

One or more embodiments relate to a golf ball having a surface divided by great circles and small circles and having dimples arranged in spherical polygons formed on a surface of a sphere of the golf ball divided by the great circles and small circles.

2. Description of the Related Art

In order to arrange dimples on a surface of a golf ball, the surface of the sphere is generally divided by the great circles into a spherical polyhedron having a plurality of spherical polygons. A great circle denotes the largest circle projected onto a plane passing through a central point of the sphere.

The dimples are arranged in the spherical polygons divided as above in such a manner that the dimples have spherical symmetry. Most spherical polyhedrons having surface of a spheres divided by the great circles include spherical regular polygons. Examples of the spherical polyhedrons frequently used to arrange dimples of a golf ball may be a spherical tetrahedron having four spherical regular triangles, a spherical hexahedron having six spherical squares, a spherical octahedron having eight spherical regular triangles, a spherical dodecahedron having twelve regular pentagons, a spherical icosahedron having twenty spherical regular triangles, a spherical cuboctahedron having six spherical squares and eight spherical regular triangles, an icosidodecahedron having twenty spherical regular triangles and twelve spherical regular pentagons, or the like.

Korean Patent No. 10-1309993 discloses a method of dividing a surface of a sphere using the great circles. However, there is a limit in improving a dimple area ratio.

When a golf ball is hit using a golf club, the golf ball starts to fly and a backspin of the golf ball is generated by a loft angle of the golf club. In this state, air is accumulated under the golf ball due to the dimples formed on a surface of the golf ball, thereby increasing the pressure. In contrast, a flow of air in an upper side of the golf ball is faster and thus pressure is decreased. Accordingly, the golf ball gradually flies higher according to the Bernoulli's principle and descends toward the ground according to the law of gravity as a hitting force decreases. In general, a lift force may be easily obtained when a dimple area ratio is high and, it is difficult to obtain the lift force when the dimple area ratio is low. Actually, when a sphere of the same specifications is hit using a driver at a speed of 100 mph, a golf ball with dimples flies a distance of about 200 m to 210 m, whereas a golf ball without dimples flies a distance of about 140 m to 150 m. As shown in the above, the role of dimples in golf balls is very important in terms of aerodynamics. Accordingly, a sufficient lift force may be obtained when the dimple area ratio on a surface of a golf ball is at least 76%. However, in the case in which dimples are arranged to be symmetrical and to a limit of 250 to 350 dimples on a surface of a spherical polyhedron including general spherical regular polygons obtained by dividing a surface of a sphere of the golf ball using the great circles, to manufacture a mold cavity satisfying the above conditions, dimples are configured to have similar diametric sizes and to be over a certain size and the kind of dimple size is decreased to two to six. As a result, a land surface where no dimple is formed inevitably increases so that the dimple area ratio is decreased, thereby negatively affecting the lift force of golf balls manufactured as above. Thus, to decrease the land surface, various kinds of dimples of very small diameters are additionally formed and filled between relatively larger dimples. In this case, as the number of the kinds of dimple sizes generally increases, the costs for manufacturing a mold cavity are increased and an overall aesthetic sense of the manufactured golf balls may be poor. In some cases, in a spherical polyhedron formed of two or more kinds of spherical regular polygons, when selecting a sort of diametric sizes of dimples, a difference according to the kinds of spherical regular polygons affects a flow of air so that flying performance may be much deteriorated. The above phenomenon occurs because a surface of a sphere is divided to obtain symmetry defined by regulations of the R & A and the U.S.G.A. to use golf balls as conforming balls. When relatively larger dimples are arranged according to the size of a spherical regular polygon having a set area, there is a limit in the area occupied by the dimples. If dimples are freely arranged to overlap each other, flying characteristics are changed greatly and thus symmetry may be damaged. Accordingly, dimples may not be freely arranged to overlap each other. Thus, neighboring dimples may have free edge (edge between neighboring dimples) even though they are very small. Furthermore, dimples adjacent to both sides of a boundary of a dividing line may intersect the dividing line to some degree. Since a mold is divided into the northern hemisphere and the southern hemisphere, it is also difficult to select the positions of dimples at both sides of a mold parting line between the northern hemisphere and the southern hemisphere. And the number or sizes of dimples are restricted by the size of spherical polygons divided as above and an empty space having no dimple, that is, a land surface portion, may be increased.

Important design factors in manufacturing golf balls may include a dimple area ratio, symmetry, the number of kinds of dimple diameters, etc. When a surface of a golf ball is divided into a spherical polyhedron to arrange dimples, a surface of a sphere of the golf ball is divided into spherical regular polygons by the great circles. The method has been recognized to be essential for obtaining symmetry of a golf ball from symmetric arrangement of dimples. However, when the great circles are used only, there is a limit in increasing the dimple area ratio due to difficulty in selection and arrangement of dimples and thus a new method to solve the above problem has been demanded.

SUMMARY

Additional aspects will be set forth in part in the description which follows and, in part, will be apparent from the description, or may be learned by practice of the presented embodiments.

According to one or more embodiments, a golf ball having a surface, in which dimples are arranged on the surface of the golf ball, a spherical regular pentagon centered on a pole of the golf ball is composed by the line segments of great circles only and divided by an equator of the golf ball, the equator being defined by one of the great circles, and combined line segments, each of the combined line segments being defined by connecting three line segments including a line segment of a small circle, a line segment of the great circle, and another line segment of the small circle, which are line segments of the great circle defining each of sides of the spherical regular pentagon and line segments of the small circle near the equator, into two near-pole spherical regular pentagons, ten near-pole spherical isosceles triangles, ten near-equator spherical pentagons, and ten near-equator spherical isosceles triangles.

According to one or more embodiments, a golf ball having a surface, in which the golf ball is symmetrical with respect to an equator, and the equator is divided into ten equal parts based on ten reference points, a spherical regular pentagon centered on a pole of the golf ball is defined by five great circles passing through two reference points which are included among the ten reference points and are located opposite to each other, a small circle passing through a reference point included among the ten reference points and a vertex of the spherical regular pentagon is defined, and a line segment of the small circle between the reference point and the vertex of the spherical regular pentagon is defined to be a small circle dividing line segment, five spherical triangles surrounding and contacting the spherical regular pentagon, five spherical triangles sharing a vertex with the five spherical triangles and contacting the equator, and five spherical pentagons located in a space between the five spherical triangles and contacting the equator are formed based on a hemisphere, and the surface is divided into a plurality of spherical polygons including the spherical regular pentagon, the five spherical triangles surrounding and contacting the spherical regular pentagon, the five spherical triangles surrounding and contacting the equator, and the five spherical pentagons, and dimples are arranged in the plurality of spherical polygons formed on the surface of the golf ball.

The combined line segments dividing the surface of the golf ball, except for the great circle defining the equator, may include a dividing line defined by a line segment belonging to a small circle connecting Point 1 (latitude 0° and longitude 0°), Point 11 (latitude 39° and longitude 18°), and Point 16 (latitude 61.4° and longitude 54°), a line segment belonging to a great circle connecting Point 16 (latitude 61.4° and longitude 54°), Point 22 (latitude 66.19818538° and longitude 90°), and Point 17 (latitude 61.4° and longitude 126°), and a line segment belonging to a small circle connecting Point 17 (latitude 61.4° and longitude 126°), Point 13 (latitude 39° and longitude 162°), and Point 6 (latitude 0° and longitude 180°); a dividing line obtained by combining a line segment belonging to a small circle connecting Point 2 (latitude 0° and longitude 36°), Point 11 (latitude 39° and longitude 18°), and Point 20 (latitude 61.4° and longitude 342°), a line segment belonging to a great circle connecting Point 20 (latitude 61.4° and longitude 342°), Point 25 (latitude 66.19818538° and longitude 306°), and Point 19 (latitude 61.4° and longitude 270°), and a line segment belonging to a small circle connecting Point 19 (latitude 61.4° and longitude 270°), Point 14 (latitude 39° and longitude) 234°, and Point 7 (latitude 0° and longitude 216°); a dividing line obtained by combining a line segment belonging to a small circle connecting Point 3 (latitude 0° and longitude 72°), Point 12 (latitude 39° and longitude 90°), and Point 17 (latitude 61.4° and longitude 126°), a line segment belonging to a great circle connecting Point 17 (latitude 61.4° and longitude 126°), Point 23 (latitude 66.19818538° and longitude 162°), and Point 18 (latitude 61.4° and longitude 198°), and a line segment belonging to a small circle connecting Point 18 (latitude 61.4° and longitude) 198°, Point 14 (latitude 39° and longitude 234°), and Point 8 (latitude 0° and longitude 252°); a dividing line obtained by combining a line segment belonging to a small circle connecting Point 4 (latitude 0° and longitude 108°), Point 12 (latitude 39° and longitude 90°), and Point 16 (latitude 61.4° and longitude 54°), a line segment belonging to a great circle connecting Point 16 (latitude 61.4° and longitude 54°), Point 21 (latitude 66.19818538° and longitude 18°), and Point 20 (latitude 61.4° and longitude 342°), and a line segment belonging to a small circle connecting Point 20 (latitude 61.4° and longitude 342°), Point 15 (latitude 39° and longitude 306°), and Point 9 (latitude 0° and longitude 288°); and a dividing line obtained by combining a line segment belonging to a small circle connecting Point 5 (latitude 0° and longitude 144°), Point 13 (latitude 39° and longitude 162°), and Point 18 (latitude 61.4° and longitude 198°), a line segment belonging to a great circle connecting Point 18 (latitude 61.4° and longitude 198°), Point 24 (latitude 66.19818538° and longitude 234°), and Point 19 (latitude 61.4° and longitude) 270°, and a line segment belonging to a small circle connecting Point 19 (latitude 61.4° and longitude 270°), Point 15 (latitude 39° and longitude 306°), and Point 10 (latitude 0° and longitude 324°).

The dimples may include one or more circular or polygonal dimples.

The dimples may have about two to eight dimple sizes.

BRIEF DESCRIPTION OF THE DRAWINGS

These and/or other aspects will become apparent and more readily appreciated from the following description of the embodiments, taken in conjunction with the accompanying drawings in which:

FIG. 5 shows the length of an side and FIG. 6 shows the interior angle;

FIG. 8 shows the interior angles and FIG. 9 shows the lengths of sides.

DETAILED DESCRIPTION

Figure 1:
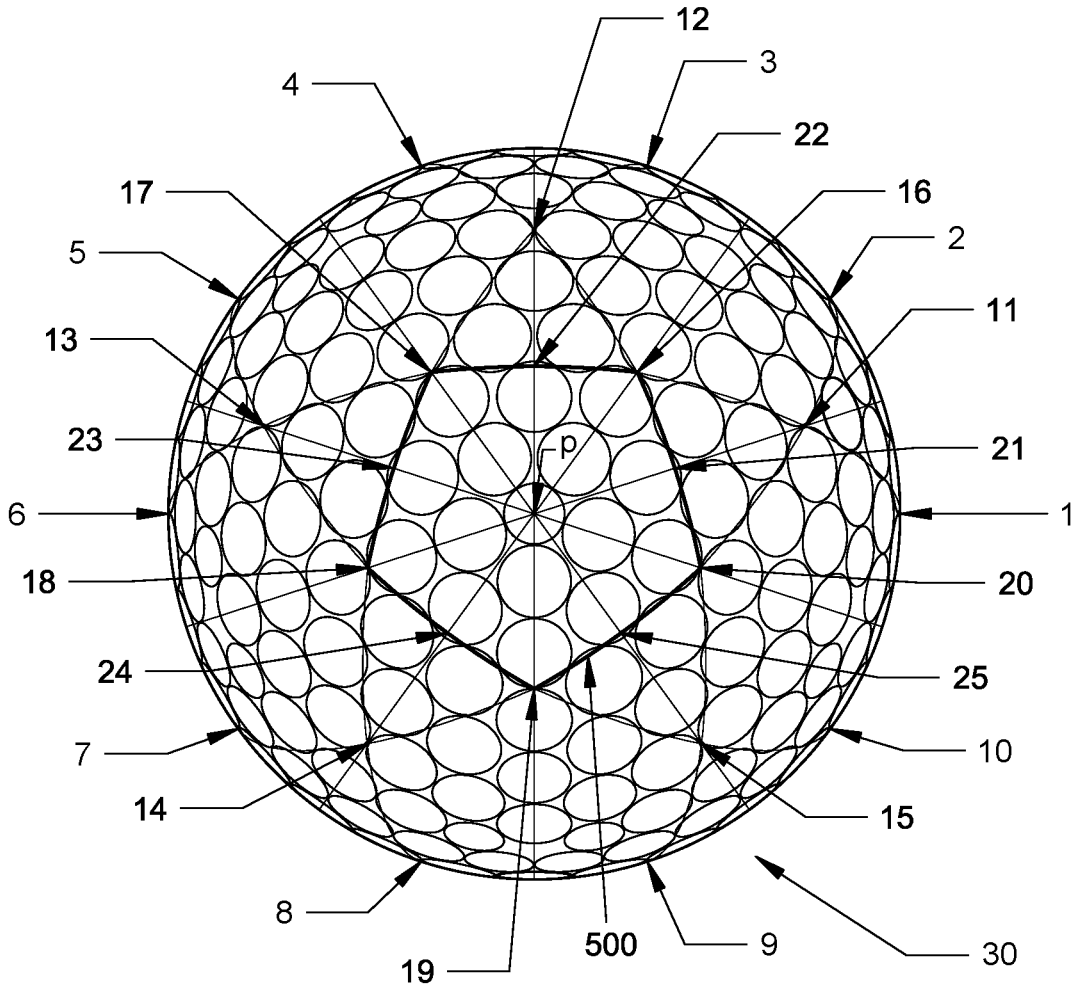
FIG. 1 is a diagram of a golf ball having a surface, on which dimples are arranged, viewed from a pole, according to an embodiment, in which a spherical regular pentagon surrounded by great circle line segments indicated by thick solid lines among line segments dividing a surface of a sphere (great circle line segments at positions different from the positions of existing great circle line segments forming an icosidodecahedron), the latitudes and longitudes of major locations where great circles, small circles connected to the great circle line segments and indicated by thin solid lines, an existing great circle forming the equator pass through, spherical polygons formed on the surface of the sphere divided by line segments combined with the great circles connected to the small circles, and dimples symmetrically arranged on the spherical polygons, are illustrated, and dimples over a certain size are regularly arranged.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

A surface dividing method while maintaining symmetry has been researched in various ways. In general, when a surface is divided by a plurality of great circles, symmetry may be maintained with no problem. In this case, however, when dimples having substantially the same size only are arranged in spherical polygons, a sufficient dimple area ratio may not be obtained, or even when a sufficient dimple area ratio is obtained by using dimples of various sizes, manufacturing a mold for such a golf ball having dimples of various sizes is difficult.

The present inventive concept is introduced as follows to remove the above problems occurring when a surface of a sphere is divided by existing great circles and dimples are arranged on a spherical polyhedron having a fixed size including spherical regular polygons, and easily maintain symmetry, in particular reducing the dimple-less land surface and increasing the dimple area ratio.

In general, in the present embodiment, instead of the existing great circles used to divide the surface of the sphere, the surface of the sphere is divided by line segments obtained by connecting and combining great circles having positions different from the positions where the surface of the sphere is divided by the existing great circles and small circles, forming spherical polygons to be symmetrical on the entire surface of a sphere, and dimples are symmetrically arranged in the spherical polygons.

The spherical polygons according to the present embodiment may include two near-pole spherical regular pentagons, each having a center at a pole and surrounded by great circle line segments having positions different from the positions which the existing great circle line segments pass through, ten spherical isosceles triangles, each having one side shared by one of the near-pole spherical regular pentagons and other two sides formed of small circles, other ten spherical isosceles triangles, each using small circle line segments extended from the two equal sides of one of the above spherical isosceles triangles as two sides and a great circle line segment forming the equator as one side, and ten near-equator spherical pentagons, each sharing one vertex of one of the near-pole spherical pentagons, sharing one side each with the two above spherical isosceles triangles, and using a great circle line segment of the equator as a base. The spherical polyhedron configured as above has quite different sizes and interior angles than the existing spherical icosidodecahedron having twelve spherical regular pentagons and twenty spherical regular triangles.

Since it is difficult to arrange dimples having similar diametric sizes and relatively less kinds to be proportional to one another with fixed sizes of spherical regular pentagons and spherical regular triangles of the exiting spherical icosidodecahedron formed by dividing the surface of the sphere by the great circles, the sizes of spherical polygons need to be adjusted. To address this issue, instead of dividing the surface of the sphere by the great circles only, great circles passing through positions different from the positions of the existing great circles and small circles, and small circles that divide a sphere and smaller than the great circles, are formed. A method of dividing a sphere, while maintaining symmetry, using dividing lines formed by connecting and combining some line segments of great circles and some line segments of small circles has been researched. A small circle denotes a small circle projected onto a certain plane to be smaller than the great circle because the plane not passing through the center of the sphere, unlike the above-described great circle. As such, the surface of the sphere is divided into a spherical polyhedron formed according to the present embodiment and then dimples are arranged thereon.

For example, ten reference points for dividing the equator into ten equal parts are determined and the ten reference points are set to be reference Point 1 to reference Point 10. Five great circles passing through two reference points facing each other among the reference points are formed.

Considering the hemisphere, each of the five great circles intersects other great circles at one point, five spherical triangles are formed around a regular pentagon, spherical pentagons, each contacting two neighboring spherical triangles, are formed, five spherical triangles are respectively formed between the neighboring spherical pentagons. The spherical triangles are all spherical isosceles triangles.

The configuration of dividing lines that divide a surface of a sphere as above is described below in detail with coordinates of points of intersections of the dividing lines.

Figure 3:
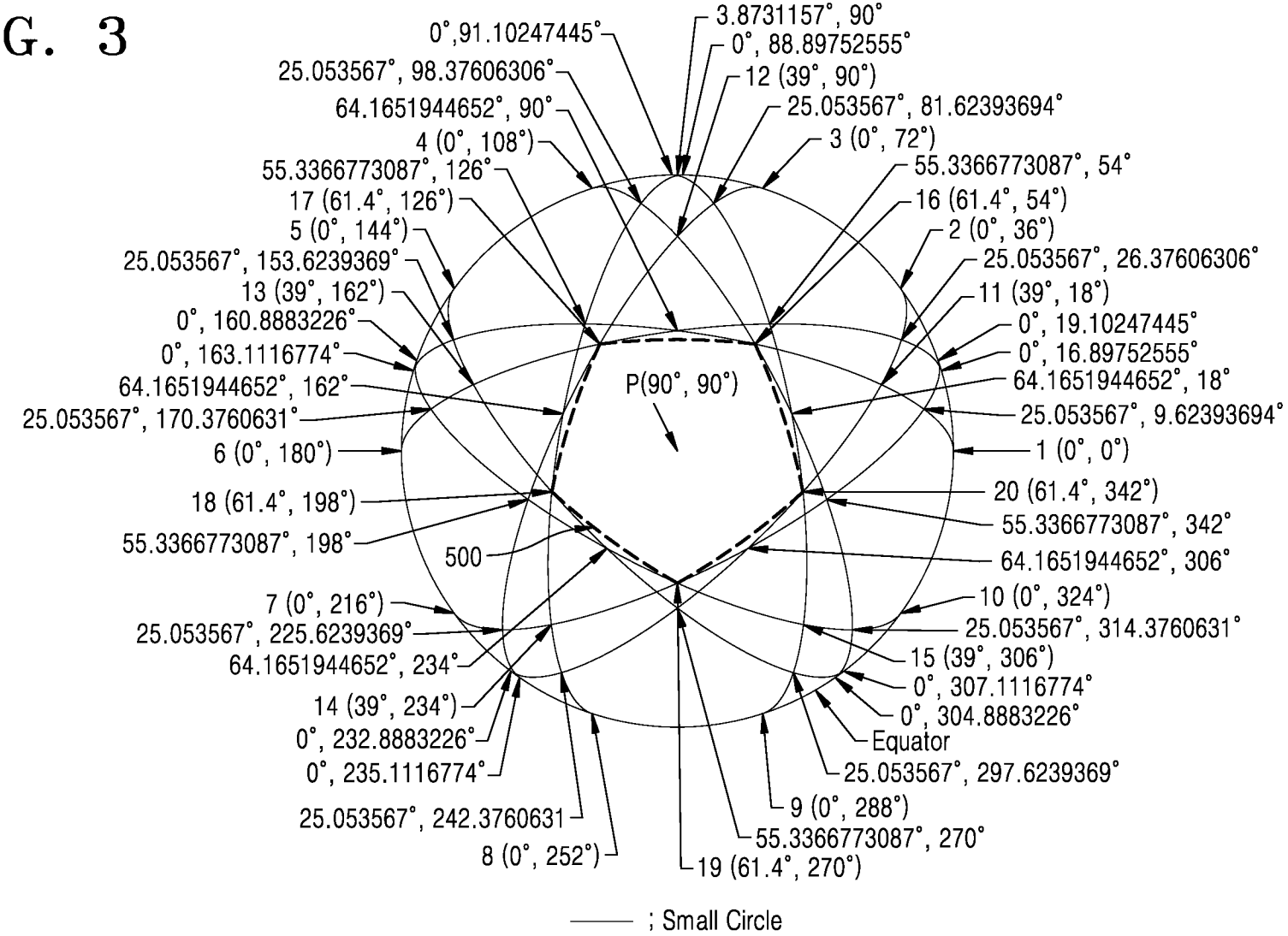
FIG. 3 illustrates the latitudes and longitudes of locations of small circle line segments (thin solid lines) used in the present embodiment, in which only necessary small circle line segments are used to form a combined dividing line of FIG. 2.

In FIG. 3, the latitudes and the longitudes of a point, which the formed small circle line segments pass through, are indicated. Only important locations of the small circle line segments needed to form the combined line segments according to the present embodiment are marked by identification numbers before the latitudes and longitudes, whereas no identification number is marked for other locations. A small circle line segment passing through Point 1 (latitude 0° and longitude 0°), Point 11 (latitude 39° and longitude 18°), Point 16 (latitude 61.4° and longitude) 54°, a point (latitude 64.1651944652° and longitude 90°), a point (latitude 55.3366773087° and longitude 126°), and a point (latitude 0° and longitude 163.1116774°) in FIG. 3 is formed. Next, a small circle line segment passing through a point (latitude 0° and longitude 16.89752555°), a point (latitude 55.3366773087° and longitude 54°), a point (latitude 64.1651944652° and longitude 90°), Point 17 (latitude 61.4° and longitude 126°), Point 13 (latitude 39° and longitude) 162°, and Point 6 (latitude 0° and longitude 180°) in FIG. 3 is formed.

Figure 4:
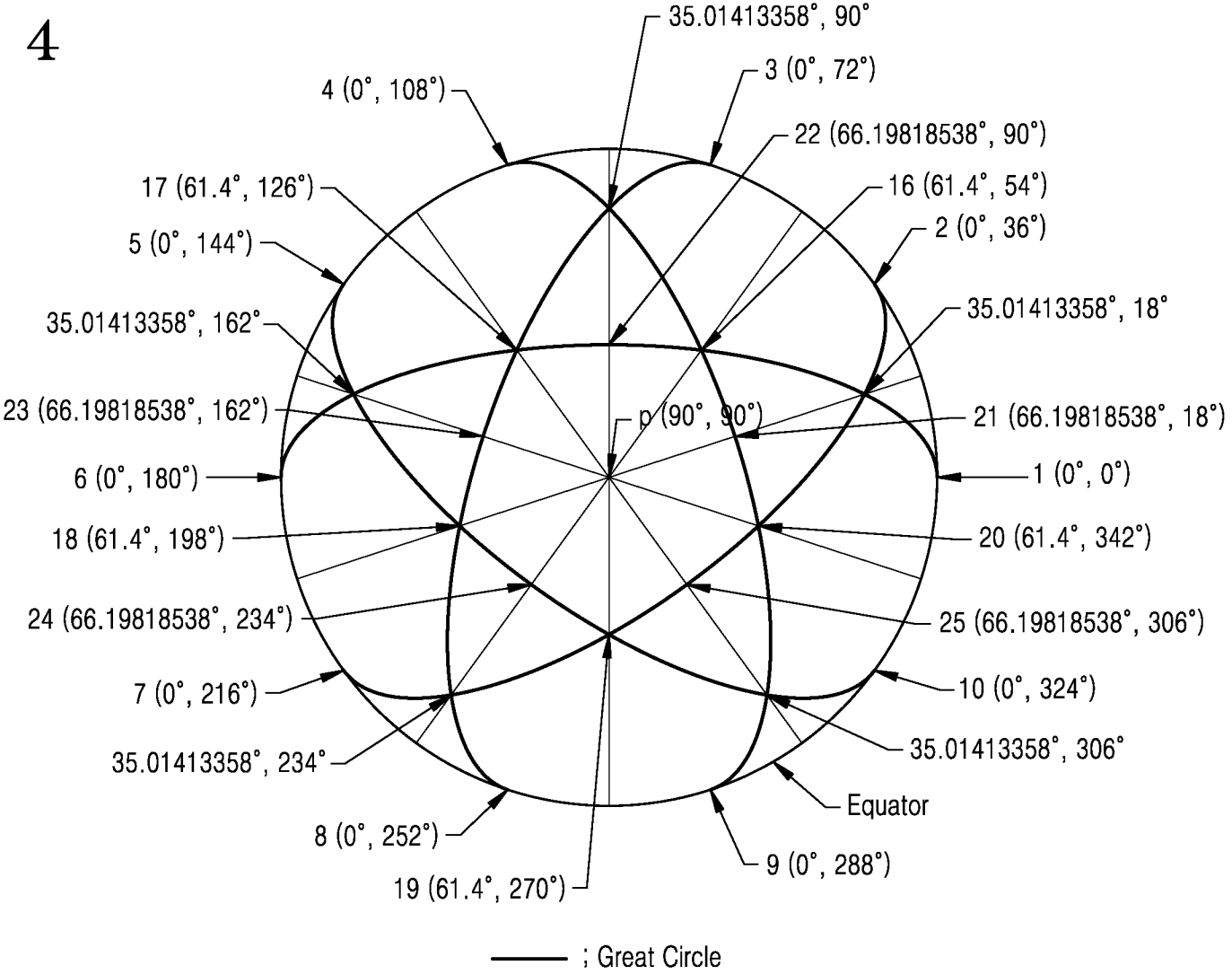
FIG. 4 illustrates the latitudes and longitudes of locations which great circle line segments (thick solid lines) at positions different from the existing great circles forming an icosidodecahedron pass through, in which only some of the great circle line segments are combined with the necessary small circle line segments of FIG. 3, thereby forming the combined line segments of FIG. 2.

A great circle line segment passing through Point 1 (latitude 0° and longitude 0°), a point (latitude 35.01413358° and longitude 18°), Point 16 (latitude 61.4° and longitude 54°), Point 22 (latitude 66.19818538° and longitude 90°), Point 17 (latitude 61.4° and longitude 126°), and Point 6 (latitude 0° and longitude 180°) in FIG. 4 is formed. From the small circle line segments of FIG. 3, a line segment from Point 1 (latitude 0° and longitude 0°) to Point 11 (latitude 39° and longitude 18°) and Point 16 (latitude 61.4° and longitude 54°) is taken. From the great circle line segments of FIG. 4, a great circle line segment from Point 16 (latitude 61.4° and longitude 54°) to Point 22 (latitude 66.19818538° and longitude 90°) and Point 17 (latitude 61.4° and longitude) 126° is taken. These two line segments are connected to each other at Point 16 (latitude 61.4° and longitude 54°). Also, in FIG. 3, a line segment from Point 17 (latitude 61.4° and longitude) 126° to Point 13 (latitude 39° and longitude 162°) and Point 6 (latitude 0° and longitude 180°) is taken and connected to the same great circle line segment of FIG. 4 at the Point 17 (latitude 61.4° and longitude 126°), thereby forming the combined dividing line in which one great circle line segment is connected between two small circle line segments.

A small circle line segment passing through Point 2 (latitude 0° and longitude 36°), Point 11 (latitude 39° and longitude 18°), Point 20 (latitude 61.4° and longitude 342°), a point (latitude 64.1651944652° and longitude 306°), a point (latitude 55.3366773087° and longitude 270°), and a point (latitude 0° and longitude 232.8883226°) in FIG. 3 is formed in the same manner. Next, a small circle line segment passing through a point (latitude 0° and longitude 19.10247445°), a point (latitude 55.3366773087° and longitude 342°), a point (latitude 64.1651944652° and longitude 306°), Point 19 (latitude 61.4° and longitude 270°), Point 14 (latitude 39° and longitude 234°), and Point 7 (latitude 0° and longitude 216°) in FIG. 3 is formed.

A great circle line segment passing through Point 2 (latitude 0° and longitude 36°), a point (latitude 35.01413358° and longitude 18°), Point 20 (latitude 61.4° and longitude 342°), Point 25 (latitude 66.19818538° and longitude 306°), Point 19 (latitude 61.4° and longitude) 270°, and Point 7 (latitude 0° and longitude 216°) in FIG. 4 is formed. From the small circle line segments of FIG. 3, a line segment from Point 2 (latitude 0° and longitude 36°) to Point 11 (latitude 39° and longitude 18°) and Point 20 (latitude 61.4° and longitude 342°) is taken. From the great circle line segments of FIG. 4, a line segment from Point 20 (latitude 61.4° and longitude 342°) to Point 25 (latitude 66.19818538° and longitude 306°) and Point 19 (latitude 61.4° and longitude 270°) is taken. These two line segments are connected to each other at Point 20 (latitude 61.4° and longitude 342°). Also, from the small circle line segments of FIG. 3, a line segment from Point 19 (latitude 61.4° and longitude 270°) to Point 14 (latitude 39° and longitude) 234° and Point 7 (latitude 0° and longitude 216°) is taken and connected to the same great circle line segment at Point 19 (latitude 61.4° and longitude 270°), thereby forming the combined dividing line in which one great circle line segment is connected between two small circle line segments.

A small circle line segment passing through Point 3 (latitude 0° and longitude 72°), Point 12 (latitude 39° and longitude 90°), Point 17 (latitude 61.4° and longitude 126°), a point (latitude 64.1651944652° and longitude 162°), a point (latitude 55.3366773087° and longitude 198°), and a point (latitude 0° and longitude 235.1116774°) in FIG. 3 is formed in the same manner. Next, a small circle line segment passing through point (latitude 0° and longitude 88.89752555°), a point (latitude 55.3366773087° and longitude 126°), a point (latitude 64.1651944652° and longitude) 162°, Point 18 (latitude 61.4° and longitude 198°), Point 14 (latitude 39° and longitude 234°), and Point 8 (latitude 0° and longitude 252°) in FIG. 3 is formed.

Next, a great circle line segment passing through Point 3 (latitude 0° and longitude 72°), a point (latitude 35.01413358° and longitude 90°), Point 17 (latitude 61.4° and longitude 126°), Point 23 (latitude 66.19818538° and longitude 162°), Point 18 (latitude 61.4° and longitude) 198°, a Point 8 (latitude 0° and longitude 252°) in FIG. 4 is formed.

From the small circle line segments of FIG. 3, a line segment from Point 3 (latitude 0° and longitude 72°) to Point 12 (latitude 39° and longitude 90°) and Point 17 (latitude 61.4° and longitude 126°) is taken. Also, from the great circle line segments of FIG. 4, a line segment from Point 17 (latitude 61.4° and longitude 126°) to Point 23 (latitude 66.19818538° and longitude) 162° and Point 18 (latitude 61.4° and longitude 198°) is taken. These two line segments are connected to each other at Point 17 (latitude 61.4° and longitude 126°). Also, from the small circle line segments of FIG. 3, a line segment from Point 18 (latitude 61.4° and longitude 198°) to Point 14 (latitude 39° and longitude 234°) and Point 8 (latitude 0° and longitude 252°) is taken and connected to the same great circle line segment at Point 18 (latitude 61.4° and longitude) 198°, thereby forming the combined dividing line in which one great circle line segment is connected between two small circle line segments.

A small circle line segment passing through Point 4 (latitude 0° and longitude 108°), Point 12 (latitude 39° and longitude 90°), Point 16 (latitude 61.4° and longitude 54°), a point (latitude 64.1651944652° and longitude 18°), a point (latitude 55.3366773087° and longitude) 342°, and a point (latitude 0° and longitude 304.8883226°) in FIG. 3 is formed in the same manner. Next, a small circle line segment passing through a point (latitude 0° and longitude) 91.10247445°, a point (latitude 55.3366773087° and longitude 54°), a point (latitude 64.1651944652° and longitude 18°), Point 20 (latitude 61.4° and longitude 342°), Point 15 (latitude 39° and longitude 306°), and Point 9 (latitude 0° and longitude 288°) in FIG. 3 is formed.

Next, a great circle line segment passing through Point 4 (latitude 0° and longitude 108°), a point (latitude 35.01413358° and longitude 90°), Point 16 (latitude 61.4° and longitude 54°), Point 21 (latitude 66.19818538° and longitude 18°), Point 20 (latitude 61.4° and longitude 342°), and Point 9 (latitude 0° and longitude 288°) in FIG. 4 is formed.

From the small circle line segments of FIG. 3, a line segment from Point 4 (latitude 0° and longitude 108°) to Point 12 (latitude 39° and longitude 90°) and Point 16 (latitude 61.4° and longitude 54°) is taken. Also, from the great circle line segments of FIG. 4, a line segment from Point 16 (latitude 61.4° and longitude 54°) to Point 21 (latitude 66.19818538° and longitude 18°) and Point 20 (latitude 61.4° and longitude 342°) is taken. These two line segments are connected to each other at Point 16 (latitude 61.4° and longitude 54°).

Also, from the small circle line segments of FIG. 3, a line segment from Point 20 (latitude 61.4° and longitude 342°) to Point 15 (latitude 39° and longitude 306°) and Point 9 (latitude 0° and longitude 288°) is taken and connected to the same great circle line segment at Point 20 (latitude 61.4° and longitude 342°), thereby forming the combined dividing line in which one great circle line segment is connected between two small circle line segments.

A small circle line segment passing through Point 5 (latitude 0° and longitude 144°), Point 13 (latitude 39° and longitude 162°), Point 18 (latitude 61.4° and longitude 198°), a point (latitude 64.1651944652° and longitude 234°), a point (latitude 55.3366773087° and longitude) 270°, and a point (latitude 0° and longitude 307.1116774°) in FIG. 3 is formed in the same manner. Next, a small circle line segment passing through point (latitude 0° and longitude) 160.8883226°, a point (latitude 55.3366773087° and longitude 198°), a point (latitude 64.1651944652° and longitude 234°), Point 19 (latitude 61.4° and longitude 270°), Point 15 (latitude 39° and longitude 306°), and Point 10 (latitude 0° and longitude 324°) in FIG. 3 is formed. Next, a great circle line segment passing through Point 5 (latitude 0° and longitude 144°), a point (latitude 35.01413358° and longitude 162°), Point 18 (latitude 61.4° and longitude 198°), Point 24 (latitude 66.19818538° and longitude 234°), Point 19 (latitude 61.4° and longitude) 270°, and Point 10 (latitude 0° and longitude 324°) in FIG. 4 is formed.

From the small circle line segments of FIG. 3, a line segment from Point 5 (latitude 0° and longitude 144°) to Point 13 (latitude 39° and longitude 162°) and Point 18 (latitude 61.4° and longitude 198°) is taken. Also, from the great circle line segments of FIG. 4, a line segment form Point 18 (latitude 61.4° and longitude 198°) to Point 24 (latitude 66.19818538° and longitude 234°) and Point 19 (latitude 61.4° and longitude 270°) is taken. These two line segments are connected to each other at Point 18 (latitude 61.4° and longitude 198°). Also, from the small circle line segments of FIG. 3, a line segment from Point 19 (latitude 61.4° and longitude 270°) to Point 15 (latitude 39° and longitude 306°) and Point 10 (latitude 0° and longitude 324°) is taken and connected to the same great circle line segment at Point 19 (latitude 61.4° and longitude 270°), thereby forming the combined dividing line in which one great circle line segment is connected between two small circle line segments.

As a result, five combined dividing lines are formed by connecting the small circle line segments and the great circle line segments. A surface of a sphere is divided by a line segment connecting Point 1 (latitude 0° and longitude 0°), Point 3 (latitude 0° and longitude 72°), Point 5 (latitude 0° and longitude 144°), Point 7 (latitude 0° and longitude 216°), Point 9 (latitude 0° and longitude 288°) and Point 1 (latitude 0° and longitude 0°)—in FIGS. 3 and 4, which corresponds to the circumference of a sphere and the great circle of the sphere, and the line segment is used as the equator.

Figure 2:
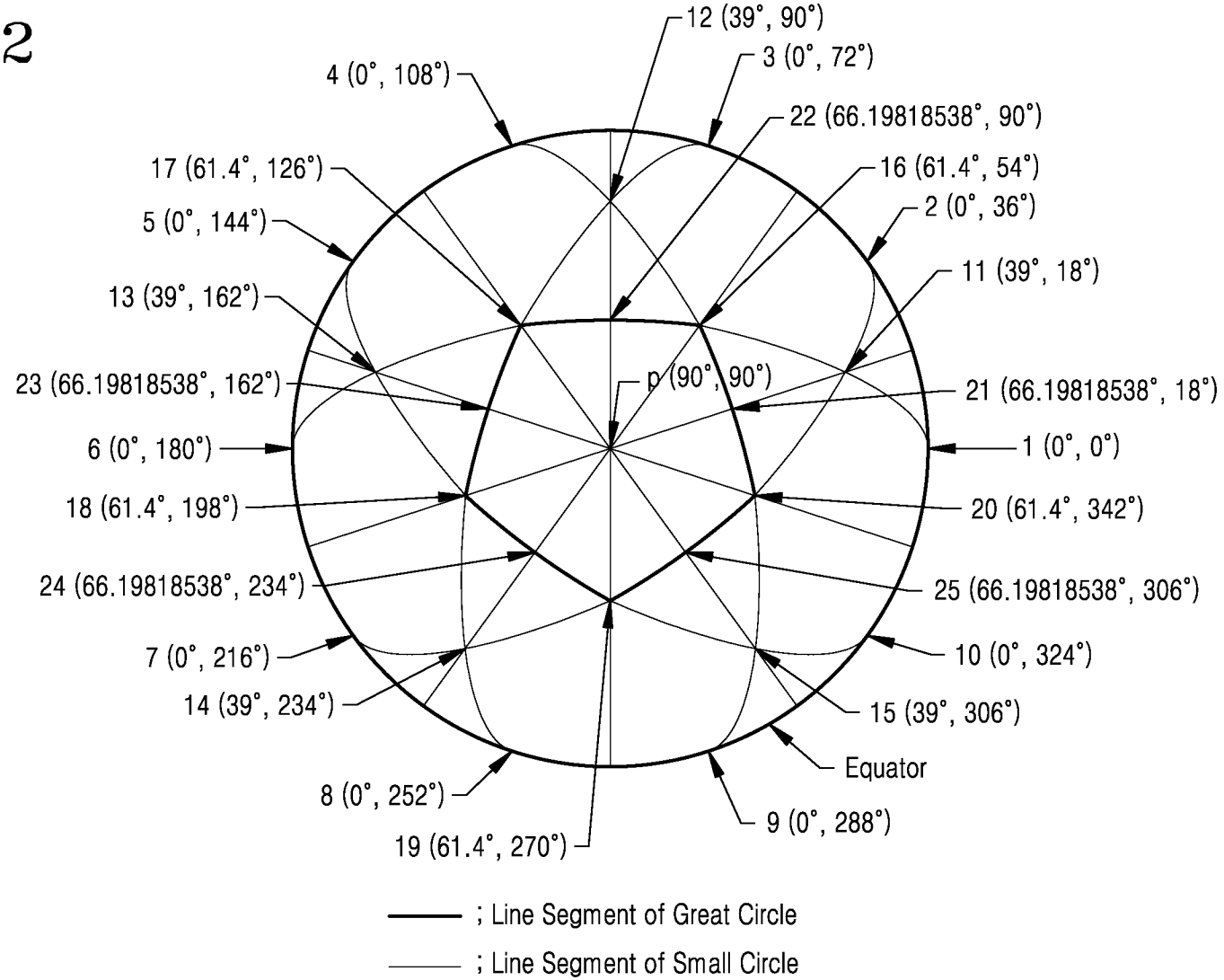
FIG. 2 illustrates the latitudes and longitudes of locations which dividing lines that are combined line segments formed by connecting dividing lines (thin solid lines) formed by small circles according to an embodiment and great circle line segments (thick solid lines) at positions different from the existing great circle line segments in an icosidodecahedron pass through, and locations of small circle line segments meeting the equator formed of a great circle, on the surface of the sphere.

FIG. 2 illustrates the combined dividing lines formed as above. Spherical polygons formed by the combined dividing lines may include two near-pole spherical regular pentagons, each having a center at the pole and surrounded by the great circle line segments, ten spherical isosceles triangles, each sharing one side of one near-pole spherical regular pentagon and having other two sides formed of small circles, other ten spherical isosceles triangles, each using small circle line segments extended from the two equal sides of one of the above spherical isosceles triangles as two sides and a great circle line segment forming the equator as one side, and ten near-equator spherical pentagons, each sharing one vertex of one of the near-pole spherical pentagons, sharing one side each with the two above spherical isosceles triangles, and using a great circle line segment of the equator as a base.

A golf ball 30 is formed by arranging dimples in the spherical polygons. The spherical polygons formed by the small circle line segments, the great circle line segments, and the great circle line segments of the equator in FIG. 2 may be expressed in FIG. 5 such that the size of an interior angle, each position where a vertex of a spherical polygon is formed, and the size of a side of each of important spherical polygons according to the present embodiment to actually arrange dimples may be expressed by angular distances and thus the sizes and number of dimples may be easily determined.

Figure 5:
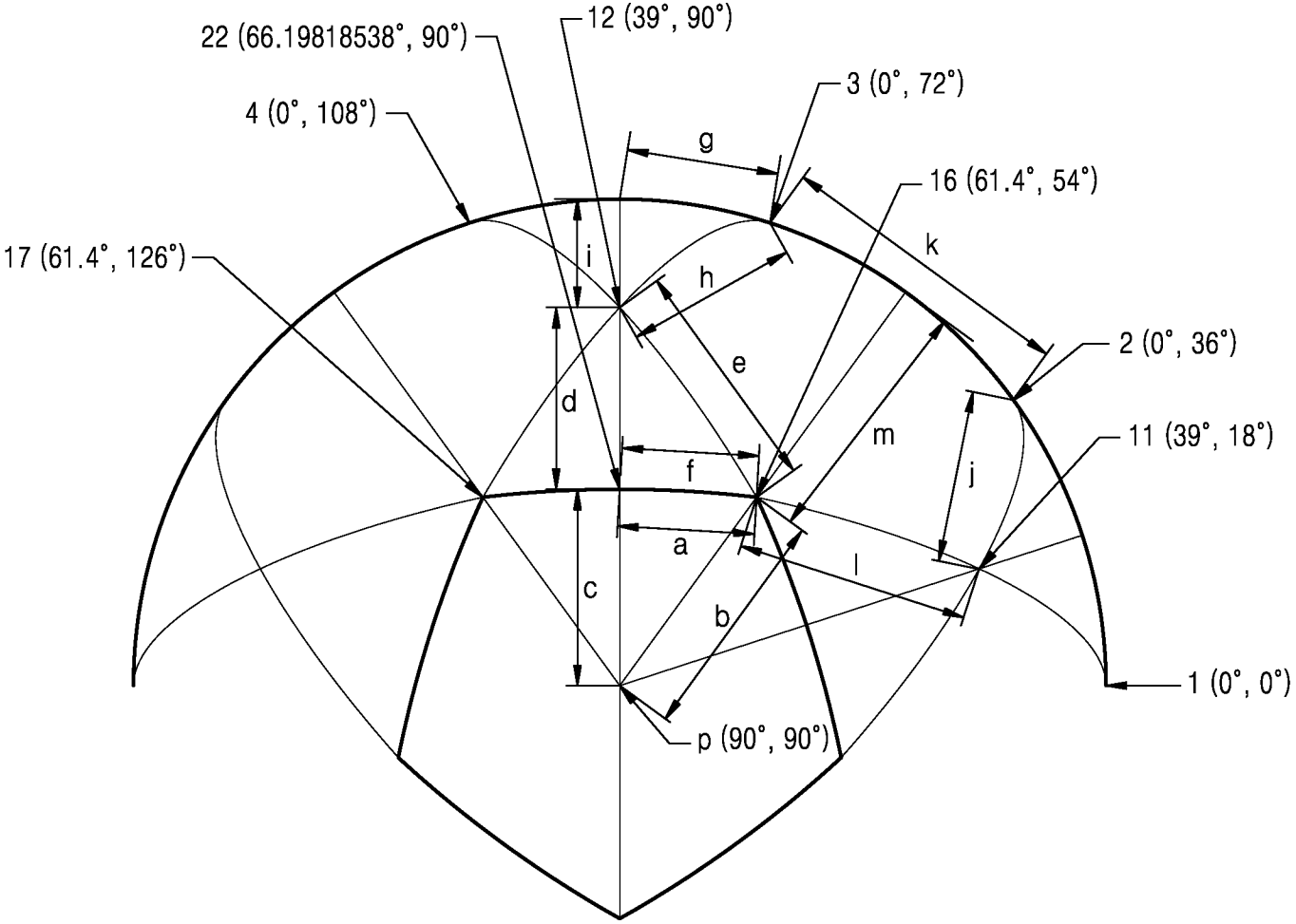
FIGS. 5 and 6 illustrate the latitudes and longitudes of locations of vertices of representative spherical polygons symmetrically provided to arrange dimples on the surface of the sphere divided according to the present embodiment, in which, to indicate sizes of the formed spherical polygons, signs are indicated to calculate an angular distance at each position of the interior angle of each vertex of a representative spherical polygon among the spherical polygons and the length of each side facing the vertex corresponding thereto, in particular.
Figure 6:
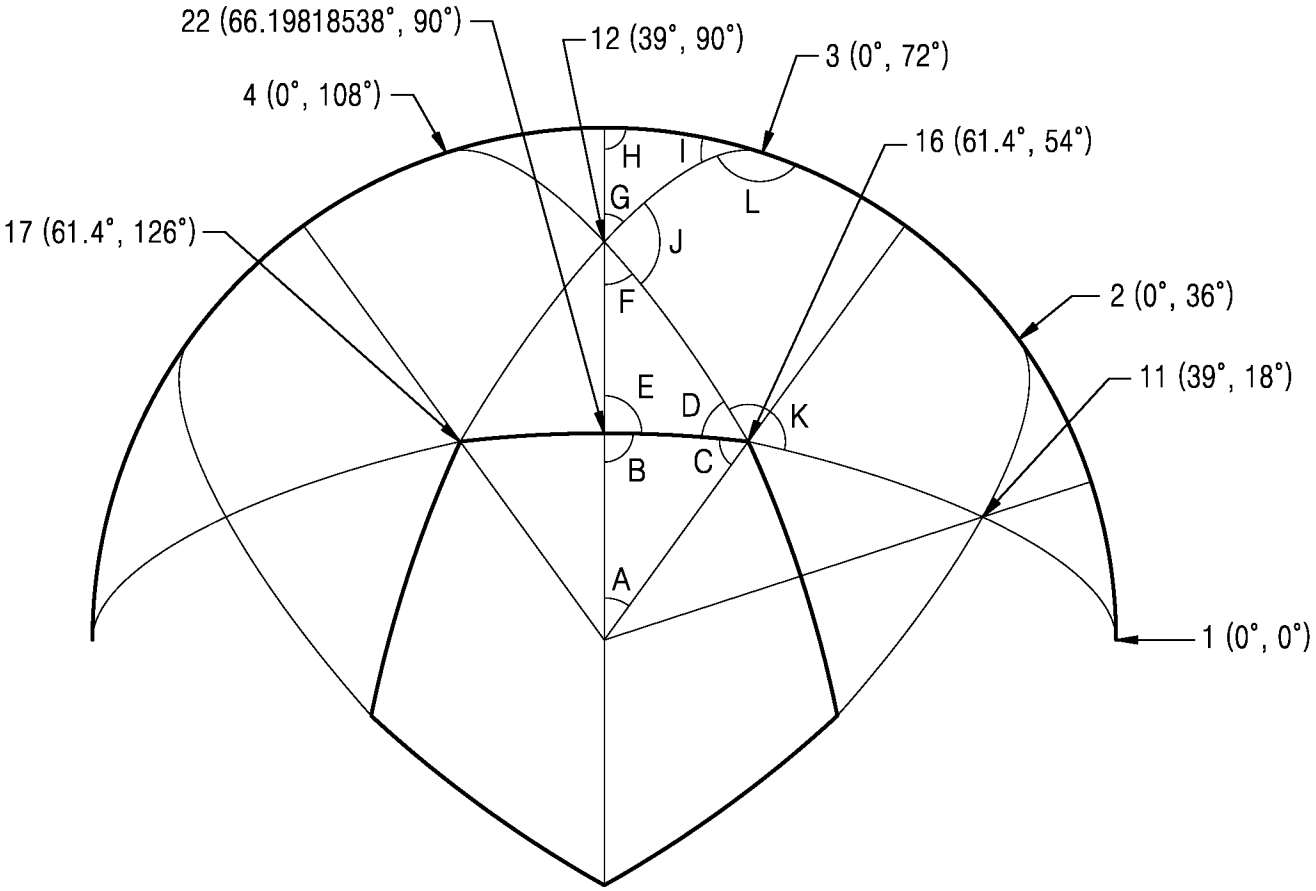

FIGS. 5 and 6 illustrate the size of a spherical regular pentagon having a center at the pole and using lines segments connecting Point 16 (latitude 61.4° and longitude 54°), 17 (latitude 61.4° and longitude 126°), 18 (latitude 61.4° and longitude 198°), 19 (latitude 61.4° and longitude 270°), and 20 (latitude 61.4° and longitude 342°) formed around the pole by using the great circle line segments in FIG. 2, as sides. An interior angle 2C of one vertex is 114.9330474°. Also, when the circumference of a sphere is 360°, a length 2a of one side is 32.68373812° angular distance. A distance connecting a middle point 22 of a side of the spherical regular pentagon of FIG. 5 and a vertex facing the middle point, that is, a height "b+c" is 52.40181462° angular distance. Two spherical regular pentagons configured as above are formed with respect to the North Pole and the South Pole.

FIGS. 5 and 6 illustrate one spherical isosceles triangle near the pole and sharing one side with the spherical regular pentagon having a center at the pole. The near-pole spherical isosceles triangle is formed by using line segments connecting Point 16 (latitude 61.4° and longitude 54°), Point 12 (latitude 39° and longitude 90°), and Point 17 (latitude 61.4° and longitude 126°), as sides. In the near-pole spherical isosceles triangle, an interior angle D of a vertex at Point 16 (latitude 61.4° and longitude 54°) is 61.29816669° angular distance and the size of an interior angle opposite to the interior angle D with respect to Point 22 (latitude 66.19818538° and longitude 90°) is the same as the interior angle D and an interior angle 2F of a vertex at Point 12 (latitude 39° and longitude 90°) is 65.3609872°. Also, when the circumference of a sphere is 360°, since the length of one side near the pole is the same as the length of one side of the near-pole spherical regular pentagon, a length 2f (=2a) of the near-pole side is 32.68373812° and a length e of each of two equal sides is 31.40582899° angular distance when the circumference of a sphere is 360°. A height d of the spherical isosceles triangle, that is, a line segment connecting a vertex of the spherical isosceles triangle, which is Point 12 (latitude 39° and longitude 90°), and a middle point of a side facing the vertex, which is Point 22 (latitude 66.19818538° and longitude 90°) is 27.19818538° angular distance when the circumference of a sphere is 360°. A total of ten near-pole spherical isosceles triangles configured as above are formed including five in the northern hemisphere and five in the southern hemisphere.

One of spherical pentagons sharing one vertex of the near-pole spherical regular pentagon of FIG. 5, sharing each side with the two near-pole spherical isosceles triangles and the two near-equator isosceles triangles, and having one side on the equator is formed by line segments connecting Point 16 (latitude 61.4° and longitude 54°), Point 11 (latitude 39° and longitude 18°), Point 2 (latitude 0° and longitude 36°), Point 3 (latitude 0° and longitude 72°), and Point 12 (latitude 39° and longitude 90°). In the spherical pentagon configured as above, an interior angle K of a vertex facing the equator is 122.4706193°, an interior angle J of a vertex at Point 12 (latitude 39° and longitude 90°) is 120.0120861°, which is the same as the interior angle of a vertex at Point 11 (latitude 39° and longitude 18°). An interior angle L of a vertex at Point 3 (latitude 0° and longitude 72°) contacting the equator is 110.8870648°, which is the same as an interior angle of a vertex at Point 2 (latitude 0° and longitude 36°) contacting the equator. When the circumference of a sphere is 360°, the length of each of two sides near the pole of the spherical pentagon is 31.40582899° angular distance, which is the same length of a side e of the near-pole spherical isosceles triangle. The length h of a line segment, which is another side of the spherical pentagon, connecting Point 12 (latitude 39° and longitude 90°) and Point 3 (latitude 0° and longitude 72°) contacting the equator is 42.34436659° angular distance. Also, the length j of another side connecting Point 11 (latitude 39° and longitude 18°) and Point 2 (latitude 0° and longitude 36°) is identically 42.34436659° angular distance. When a line segment perpendicularly connecting from an equator line segment of the near-equator spherical pentagon to Point 16 (latitude 61.4° and longitude 54°) is set to be the height of the near-equator spherical pentagon, a height m is 61.4° angular distance when the circumference of a sphere is 360°. A total of ten near-equator spherical pentagons configure as above are formed including five in the northern hemisphere and five in the southern hemisphere.

FIG. 5 illustrates one of the near-equator spherical triangles sharing the side with the near-equator spherical pentagon. In a spherical triangle having line segments connecting Point 12 (latitude 39° and longitude 90°), 4 (latitude 0° and longitude 108°), and 3 (latitude 0° and longitude 72°), as sides, an interior angle 2G of a vertex at Point 12 is 54.61484058°, an interior angle I of a vertex at Point 3 is 69.11293519°, and the size of an interior angle of a vertex at Point 4 is the same as the interior angle I. The length of one side h of the near-equator spherical triangle connecting Point 12 and Point 3 of FIG. 5 is 42.34436659° angular distance when the circumference of a sphere is 360°. The length of a side connecting Point 12 and Point 4 is identically 42.34436659° angular distance. A length 2 g of a line segment between Point 3 and Point 4, that is, the side of the near-equator spherical triangle contacting the equator, as a part of the equator line segment, is 36° angular distance. When a line segment of the near-equator spherical triangle from the vertex at Point 12 to the equator perpendicularly is set to be the height of the near-equator spherical triangle, a height i is 39° angular distance when the circumference of a sphere is 360°. A total of ten near-equator spherical triangles configure as above are formed including five in the northern hemisphere and five in the southern hemisphere.

Figure 7:
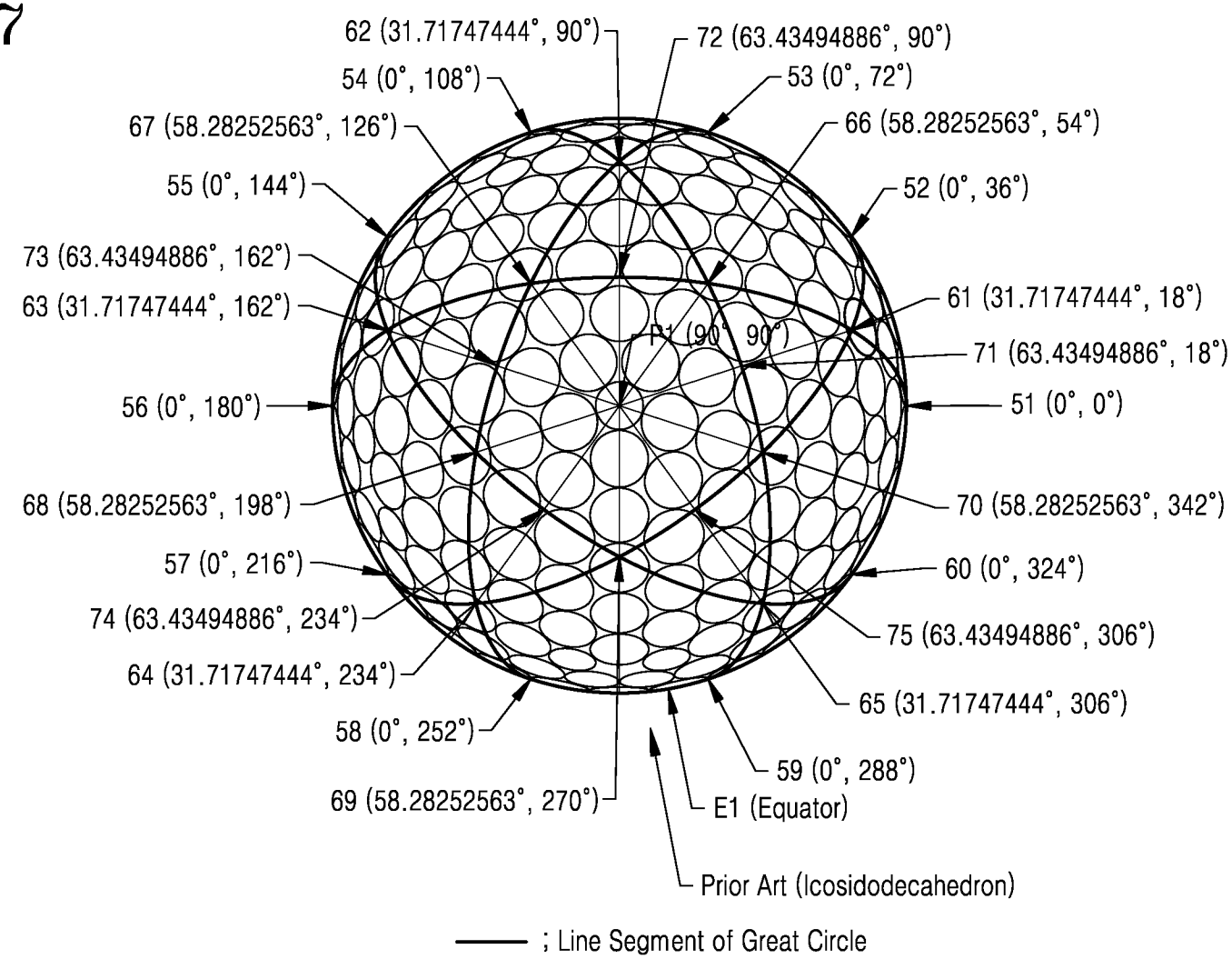
FIG. 7 illustrates a comparative example, in which a surface of a sphere is divided by the existing great circles, forming an icosidodecahedron, and the same dimple arrangement as in the present embodiment is performed, that is, dimples of small dimple types and over a certain size are arranged, showing the latitudes and longitudes of locations which great circles pass through and that accurate dividing is difficult because dimples are spaced relatively farther from dividing lines.

FIG. 7 illustrates an existing spherical icosidodecahedron (or icosahedron), as a comparative example, whose surface of a sphere is divided by great circles and dimples are arranged thereon. The surface of the sphere is divided by a great circle line segment passing through Point 51 (latitude 0° and longitude 0°), Point 66 (latitude 58.28252563° and longitude) 54°, Point 67 (latitude 58.28252563° and longitude 126°), and Point 56 (latitude 0° and longitude 180°). The surface of the sphere is divided again by a great circle line segment passing through Point 52 (latitude 0° and longitude 36°), Point 70 (latitude 58.28252563° and longitude) 342°, Point 69 (latitude 58.28252563° and longitude 270°), and Point 57 (latitude 0° and longitude 216°). The surface of the sphere is divided again by a great circle line segment passing through Point 53 (latitude 0° and longitude 72°), Point 67 (latitude 58.28252563° and longitude) 126°, Point 68 (latitude 58.28252563° and longitude 198°), and Point 58 (latitude 0° and longitude 252°). The surface of the sphere is divided again by a great circle line segment passing through Point 54 (latitude 0° and longitude 108°), Point 66 (latitude 58.28252563° and longitude 54°, Point 70 (58.28252563° and longitude 342°), and Point 59 (latitude 0° and longitude 288°). The surface of the sphere is divided again by a great circle line segment passing through Point 55 (latitude 0° and longitude 144°), Point 68 (latitude 58.28252563° and longitude 198°), Point 69 (latitude 58.28252563° and longitude 270°), and Point 60 (latitude 0° and longitude 324°). A great circle connecting line segments passing through Point 51 (latitude 0° and longitude 0°), Point 53 (latitude 0° and longitude 72°), Point 55 (latitude 0° and longitude 144°), Point 57 (latitude 0° and longitude 216°), and Point 59 (latitude 0° and longitude 288°) is used as the equator. After dividing the surface of the sphere by using the great circles, forming an existing spherical icosidodecahedron, the same dimples as in the present embodiment area arranged as illustrated in FIG. 7. However, the surface of the sphere does not seem to be accurately divided with an existing dividing scheme. The sizes of interior angles and the lengths of sides of each of spherical polygons of the existing spherical icosidodecahedron are displayed in the same dimple arrangement of the present invention for comparing the present invention with the existing spherical icosidodecahedron.

Figure 8:
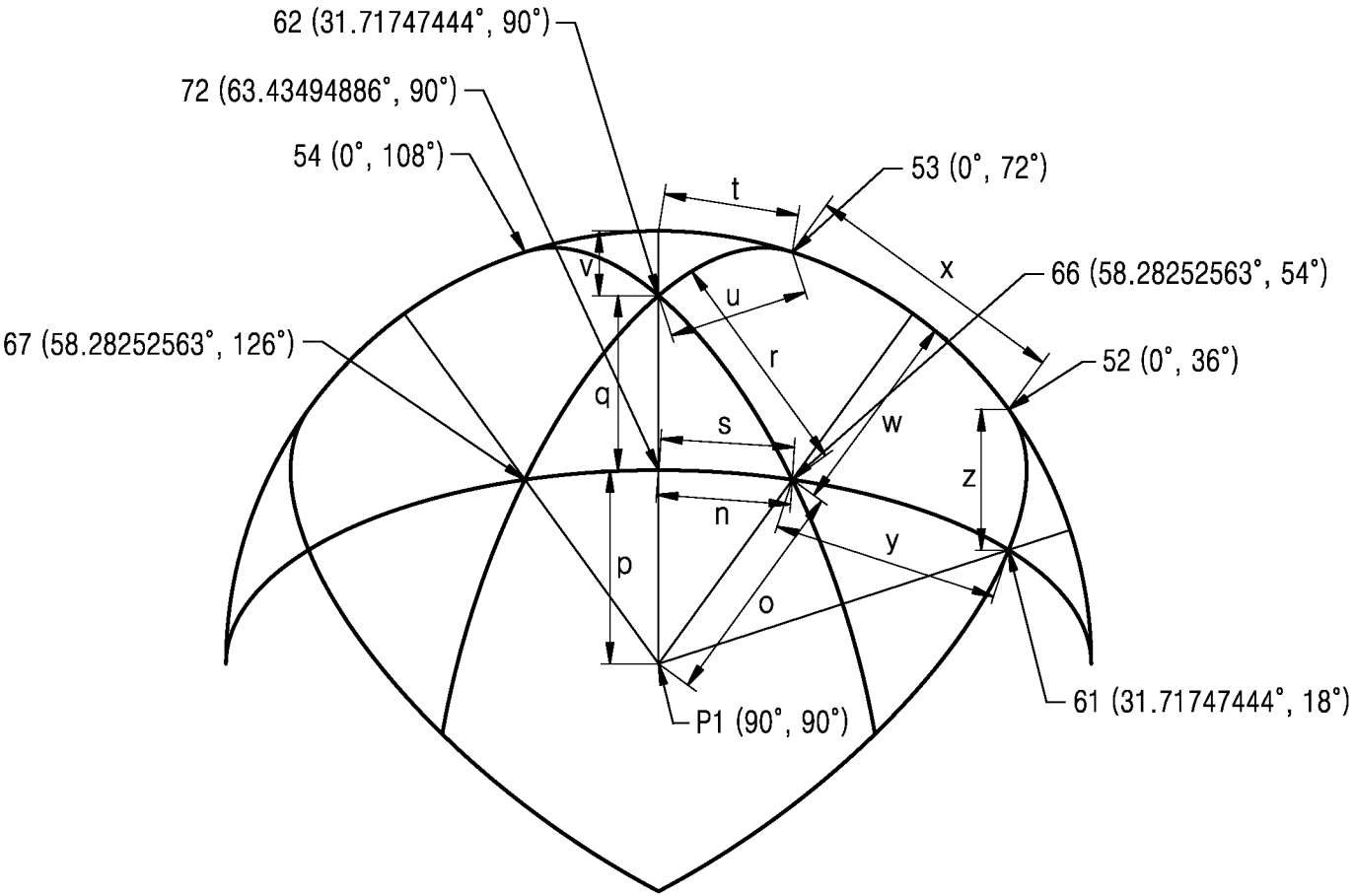
FIGS. 8 and 9 illustrate a comparison in the size between the existing divided icosidodecahedron of FIG. 4 and the spherical polygons of FIG. 1 or 2 according to the present embodiment, by calculating the interior angles and the lengths of sides of a spherical regular pentagon including a pole, a spherical regular triangle near the pole, a spherical regular pentagon near the equator, and a spherical regular triangle near the equator to compare with those of the present embodiment, in particular.
Figure 9:
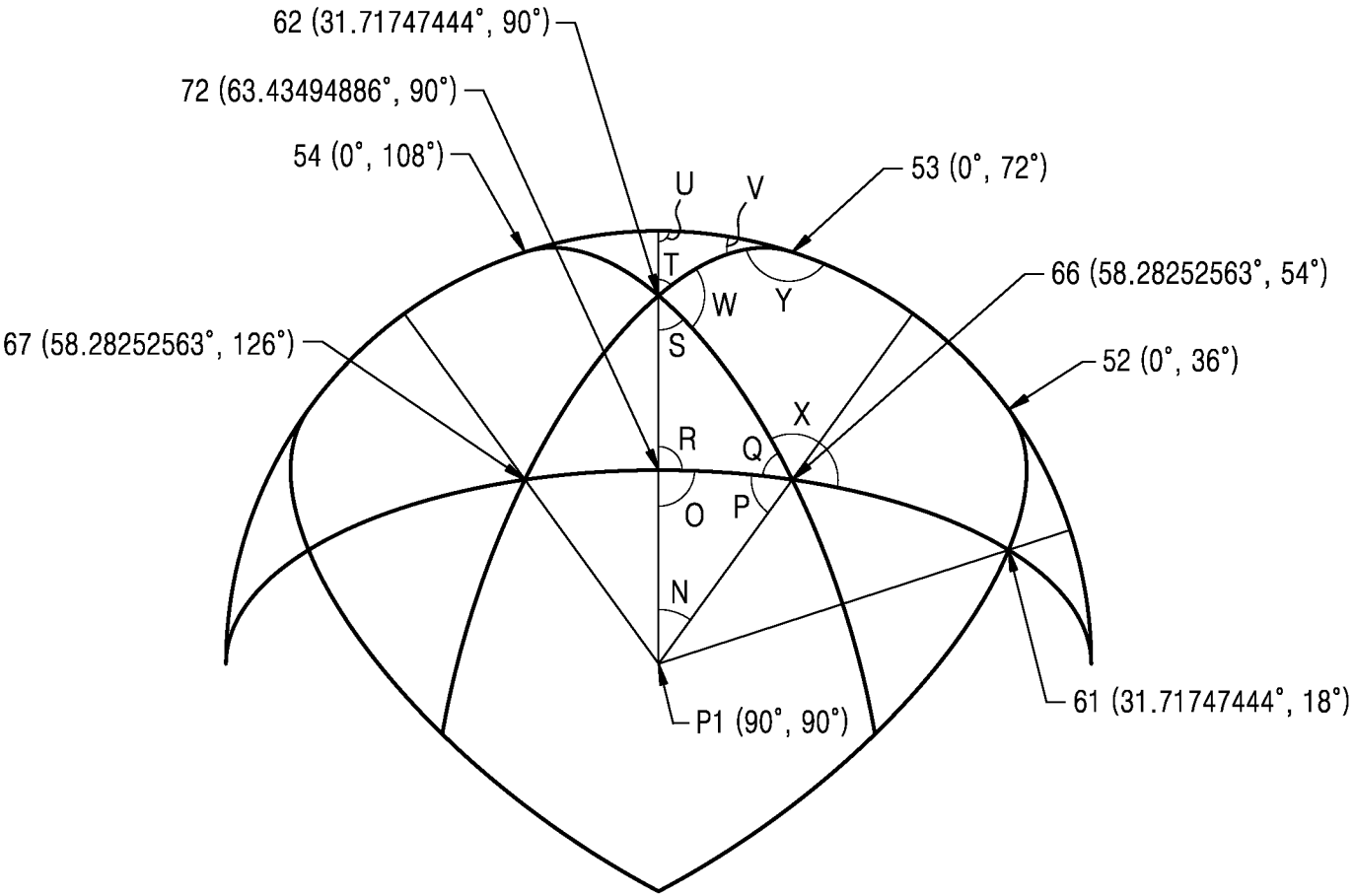

In FIG. 8 and FIG. 9, an interior angle 2P of a vertex of a near-pole spherical regular pentagon formed by being divided by the existing great circles is 116.5650512°, and when the circumference of a sphere is 360°, a length 2n of one side of the spherical regular pentagon is 36° angular distance. The lengths of all sides of the spherical regular pentagon are the same. A height "o+p" of the spherical regular pentagon is 58.28252563° angular distance.

The size of the spherical regular triangle formed by the great circle line segments connecting Point 66 (latitude 58.28252563° and longitude 54°), Point 62 (latitude 31.71747444° and longitude 90°), and Point 67 (latitude 58.28252563° and longitude 126°). An interior angle Q of one vertex is 63.43494886°, and another interior angle 2S in the regular triangle at Point 62 is 63.43494886°, that is, all spherical regular triangles have the same interior angles. Also, when the circumference of a sphere is 360°, a length 2s of one side of the near-pole spherical regular triangle is 36° angular distance and a length r of another side thereof is 36° angular distance, that is, the spherical regular triangles have the same side lengths. Also, a height q of the spherical regular triangle connecting a middle point of one side and a vertex facing the middle point is 31.71747444° angular distance. Also, FIG. 8 and FIG. 9 illustrates the size of the near-equator spherical pentagon of the spherical icosidodecahedron divided by the existing great circles. One of spherical pentagons sharing one vertex with the near-pole spherical regular pentagon, sharing each side with the two near-pole spherical isosceles triangles and the two near-equator isosceles triangles, and having one side on the equator is formed by the line segments connecting Point 66 (latitude 58.28252563° and longitude 54°), 61 (latitude 31.71747444° and longitude 18°), 52 (latitude 0° and longitude 36°), 53 (latitude 0° and longitude 72°), and 62 (latitude 31.71747444° and longitude 90°). An interior angle X of a vertex of the spherical pentagon facing the equator is 116.5650511°, and an interior angle W of a vertex at Point 62 is 116.5650511°, which is the same as an interior angle of a vertex at Point 61. An interior angle Y of a vertex at Point 53 contacting the equator is 116.5650511°, which is the same as an interior angel of a vertex at Point 52 (latitude 0° and longitude 36°) contacting the equator. Accordingly, the interior angles of all vertices of the near-equator spherical regular pentagon are the same. The length of each of two sides near the pole of the pole spherical pentagon is 36° angular distance that is the same as a side r of the near-pole spherical isosceles triangle when the circumference of a sphere is 360°. A length x of a line segment connecting Point 52 and Point 53 contacting the equator, that is, another side of the near-equator spherical pentagon, is 36° angular distance. Also, a length z of another side connecting Point 61 (latitude 31.71747444° and longitude 18°) and Point 52 (latitude 0° and longitude 36°) is identically 36° angular distance. When a line segment perpendicularly connecting Point 66 (latitude 58.28252563° and longitude 54°) of the near-equator spherical pentagon and the equator is set to be the height of the near-equator spherical pentagon, a height w is 58.28252563° angular distance when the circumference of a sphere is 360°.

FIG. 8 and FIG. 9 illustrates one of the near-equator spherical triangles sharing the sides with the near-equator spherical pentagon. In a spherical triangle having lines segments of Point 62 (latitude 31.71747444° and longitude 90°), 54 (latitude 0° and longitude 108°), and 53 (latitude 0° and longitude 72°), as sides, an interior angle 2T of a vertex at Point 62 is 63.43494886° and an interior angle V of a vertex at Point 53 is 63.43494886°. An interior angle at Point 54 is the same as the interior angle V. A length u of one side of the near-equator spherical triangle connecting Point 62 and Point 53 is 36° angular distance when the circumference of a sphere is 360°. A length of a side connecting Point 62 and Point 54 is identically 36° angular distance. A length 2t of a line segment between Point 53 and Point 54, that is, a side of the near-equator spherical triangle contacting the equator, as a part of a line segment of the equator, is 36° angular distance. When a line segment perpendicularly connecting a vertex at Point 62 of the near-equator spherical triangle and the equator is set to be the height of the near-equator spherical triangle, a height v is 31.71747444° angular distance when the circumference of a sphere is 360°. Accordingly, in the spherical icosidodecahedron divided by the existing great circles, the twelve spherical regular pentagons have the same size and the twenty spherical regular triangles have the same size. In other words, when the circumference of a sphere is 360°, the lengths of all sides of the spherical icosidodecahedron are identically 36°. All interior angles of the spherical regular pentagon are identically 116.5650511°, and all interior angles of the spherical regular triangle are identically 63.43494886°.

As mentioned above, when same dimples having the sizes according to the present embodiment are arranged on the spherical icosidodecahedron formed by dividing a surface of a sphere by using the existing great circles only, as illustrated in the drawings, the surface of the sphere may not be accurately divided. When other kinds of dimples are used, there may be many land areas having no dimple due to the sizes of the spherical polygons. Accordingly, according to the present inventive concept, the surface of the sphere is divided by using the combined line segments of the small circles and the great circles having different positions from the positions where the surface of the sphere is divided by the existing great circles, instead of using the existing great circles divided a surface of a sphere, the spherical polygons having symmetry on the entire surface of a sphere. As a result, dimples may be arranged to have spherical symmetry by restricting the number of dimples about 250 to 350 on the spherical polygons, making the diametric sizes of dimples to be similar to one another and over a certain size, and reducing the diametric types of dimples to two to six kinds.

As described above, although a method of dividing a surface of a sphere by using the great circles only according to the related art has been continuously used to easily secure symmetry, in the present inventive concept, the small circles are used for dividing a surface of a sphere in addition to the great circles, thereby obtaining the following remarkable effects.

Compared to the land surface formed on the existing spherical icosidodecahedron (or spherical icosahedron) formed by dividing a surface of a sphere by using the great circles, in the present inventive concept, the land surface formed on the spherical polyhedron formed by dividing lines by the small circles and the great circle line segments having different positions and the existing great circle line segments forming the equator is much smaller. Accordingly, the maximum dimple area ratio obtained when 250 to 350 circular dimples are arranged on the existing spherical icosidodecahedron including twenty spherical regular triangles and twelve spherical regular pentagons may be increased by about 2% to 4%, that is, from about 79% to 80% to about 83% to 84%. Also, the phenomenon that boundaries are not smoothly formed when dimples over a certain size are arranged on the existing icosidodecahedron may be removed so that the dimple area ratio may be improved and a flight distance may be further increased. In particular, since the kinds of dimples according to the diameter may be reduced to two to six kinds and then a mold cavity may be manufactured, mold manufacturing costs may be reduced and an aesthetic external appearance may be obtained.

Figure 10:
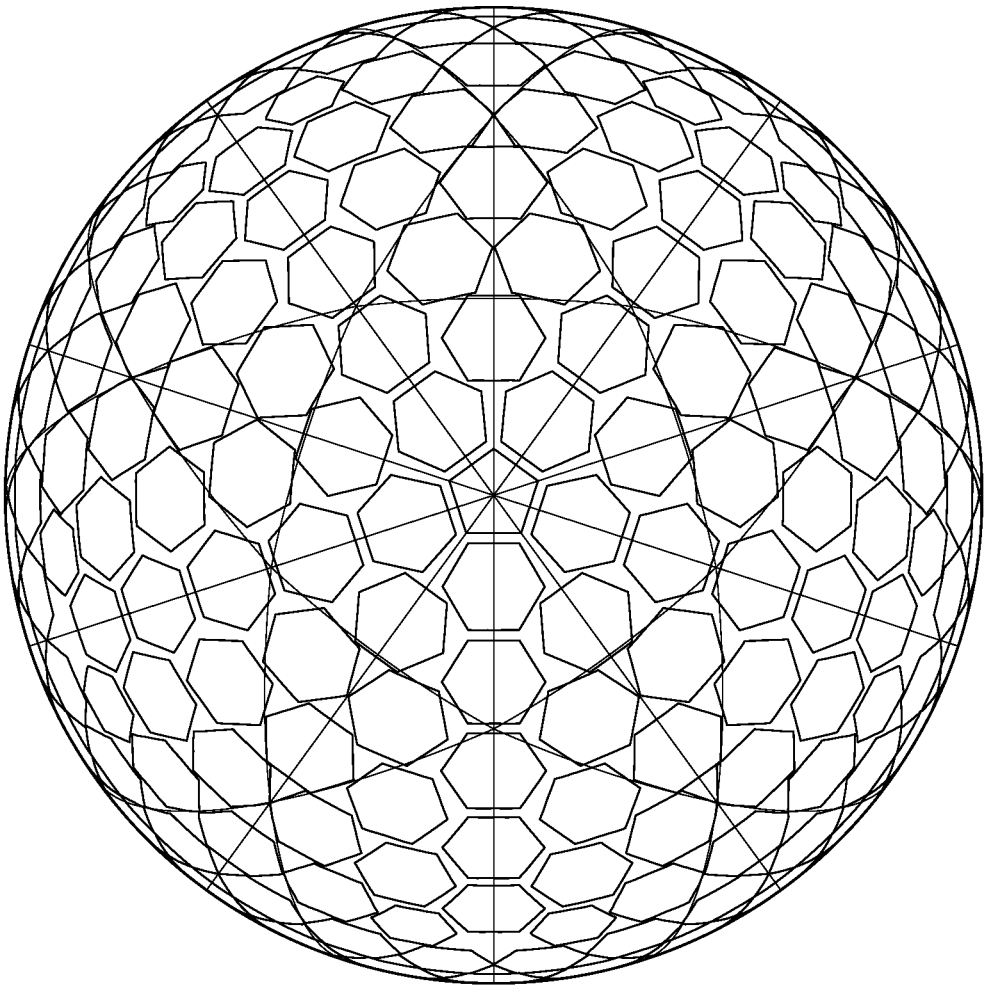
FIG. 10 shows that the dimples may comprise one or more polygonal dimples.

FIG. 10 shows that the dimples may comprise one or more polygonal dimples.

Figure 11:
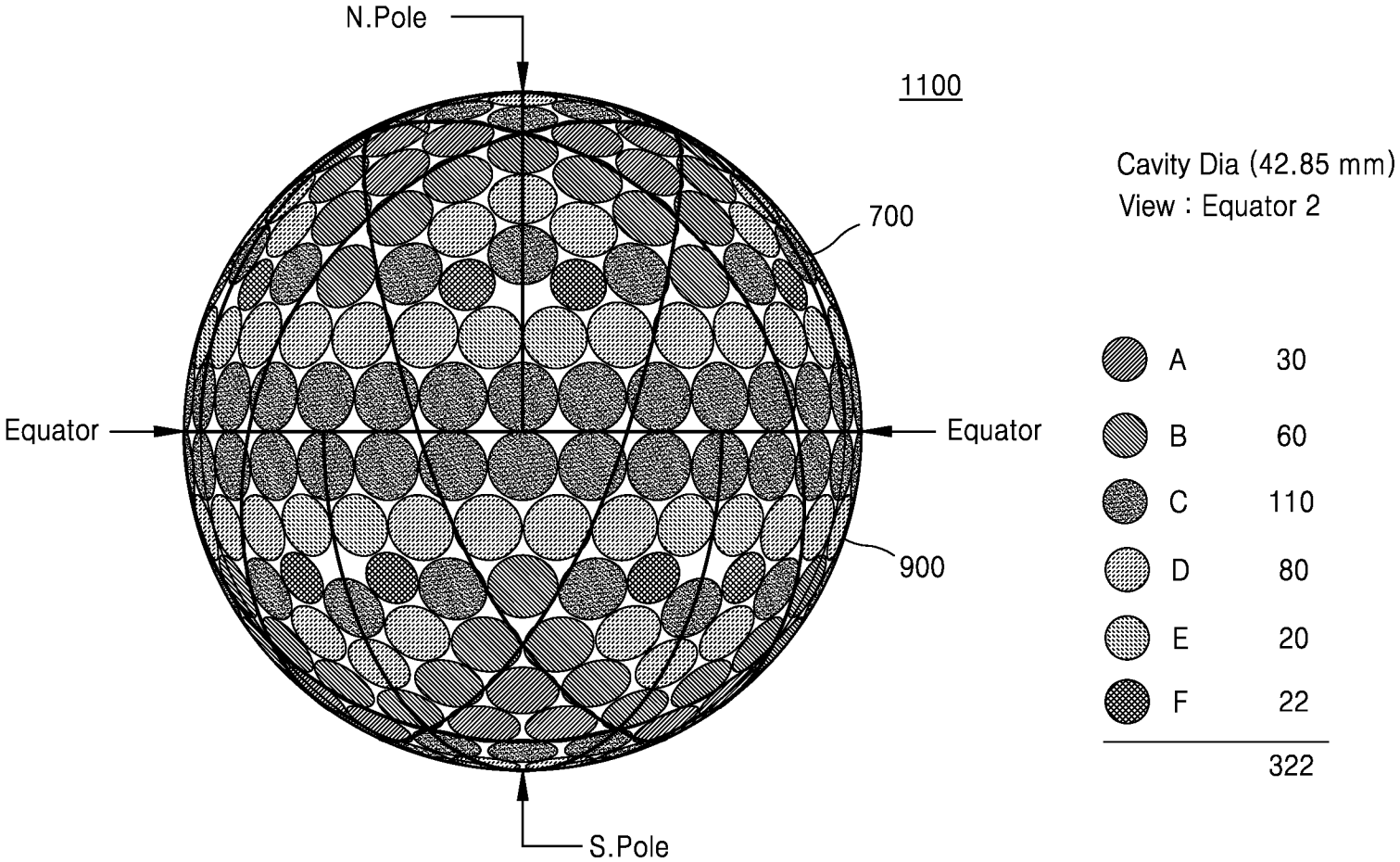
FIGS. 11 through 13 are views respectively showing one of three methods of joining two hemispherical semi-finished products to form golf balls according to the present invention.
Figure 12:
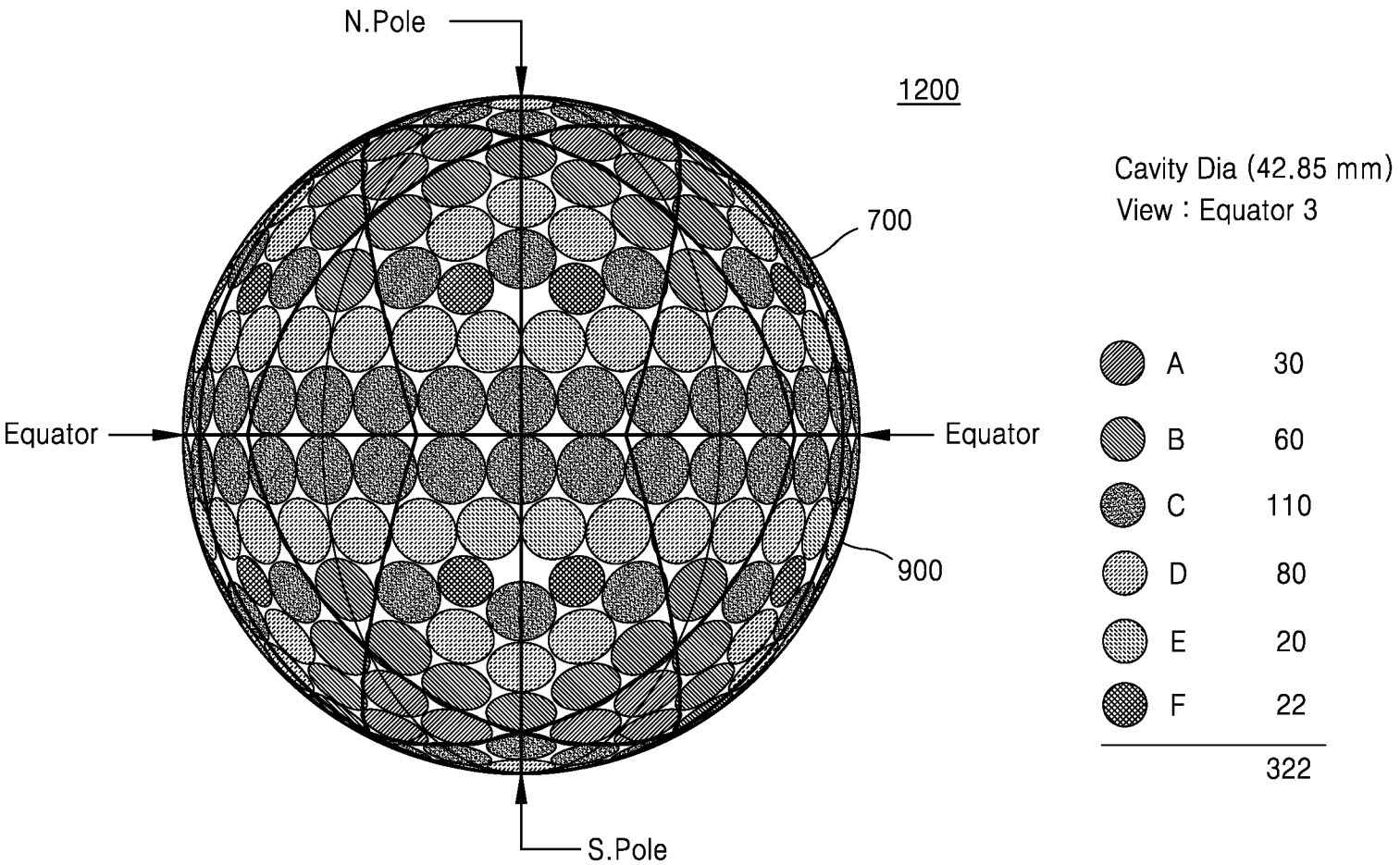
Figure 13:
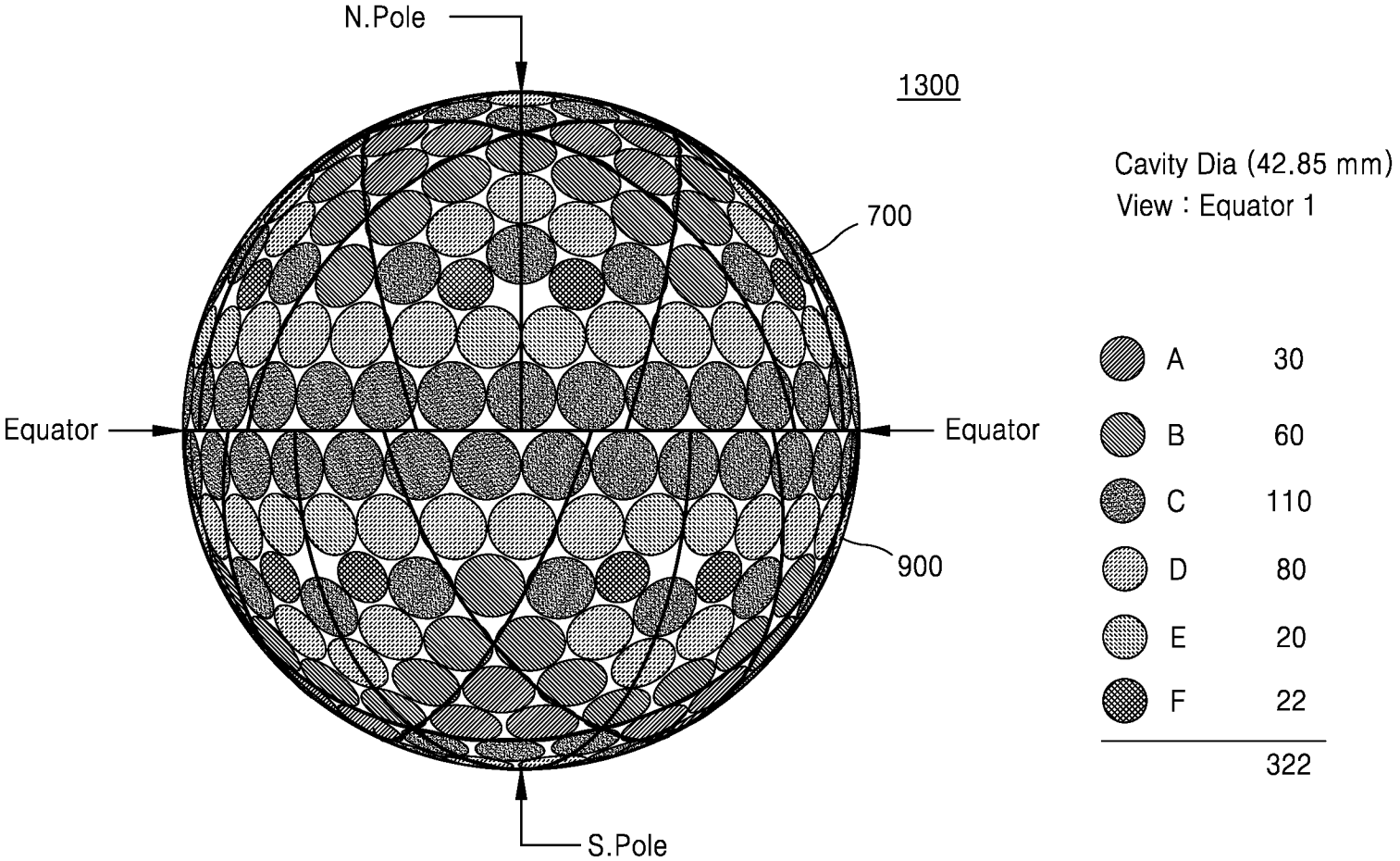

FIGS. 11 through 13 are views respectively showing one of three methods of joining two hemispherical semi-finished products to form golf balls according to the present invention.

As shown in FIG. 11, the northern hemisphere 700 and the southern hemisphere 900 can be joined so that the dimples adjacent to the equator of the hemispheres contact each other at one point.

In FIG. 11, each half finished product has 30 same sized dimples adjacent to its equator, and the equators of two half finished products of golf ball into a golf ball is joining the two half finished products so that each equators of them may face each other with a southern hemisphere rotated by 36 degrees in a counterclockwise direction relative to a northern hemisphere.

Alternatively, as shown in FIG. 12, the dimples may be mutually opposed with respect to the dimples adjacent to the equator of the hemispheres 700, 900 so that the northern hemisphere 700 and the southern hemisphere 900 are mutually symmetrical.

The embodiment shown in FIG. 11 differs from the embodiment shown in FIG. 12 in that the golf ball is formed in a completely symmetrical shape on the basis of the equator. So when the equator is hit at the time of impact, the rotation the golf ball of the embodiment shown in FIG. 12 can be completely symmetrical.

In the embodiment shown in FIG. 11, the northern hemisphere 700 and the southern hemisphere 900 are joined each other being rotated at a relative angle of 36 degrees from the symmetrical position of the embodiment shown in FIG. 12.

As shown in FIG. 13, the dimples adjacent to the equator in the southern hemisphere 900 and the dimples adjacent to the equator in the northern hemisphere 700 can be arranged so as to be staggered from each other. In this case, each area of the land portion on both sides of the equator is relatively smaller than FIGS. 11 and 12.

In FIG. 13, each half finished product has 30 same sized dimples adjacent to its equator, and the joining equators of two half finished products of golf ball into a golf ball is joining the two half finished products so that each equators of them may face each other with a southern hemisphere rotated by 30 degrees in a counterclockwise direction relative to a northern hemisphere.

Figure 14:
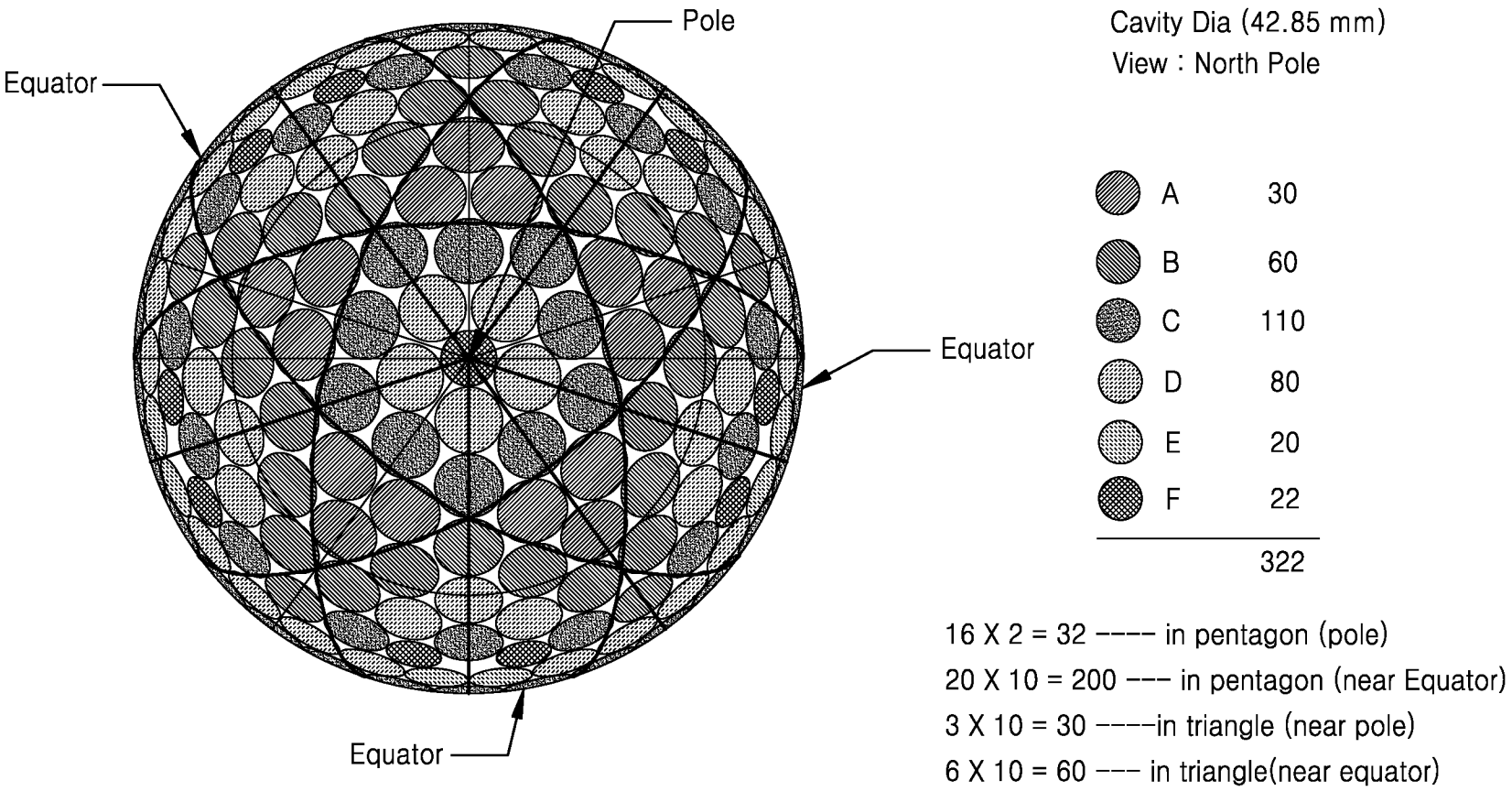
FIG. 14 shows the circular dimples arranged in the respective spherical polygons with the different-sized dimples differently hatched so as to easily grasp the sizes (diameters) of the circular dimples.

In FIG. 14, the different-sized dimples has different hatching so as to easily grasp the sizes (diameters) of the circular dimples arranged in the respective spherical polygons.

For a golf ball having a diameter of 42.85 mm, 30 dimples having a diameter of A, 60 dimples having a diameter of B, 110 dimples having a diameter of C, 80 dimples having a diameter of D, 20 dimples having a diameter of E, and 22 dimples having a diameter of F. The diameter A is the largest, smaller in the order of A, B, C, D and E, and the diameter F is the smallest. When the dimples are arranged in this manner, the ratio of the size of the dimples having the smallest size to the size of the dimples having the largest size is 77.7% or more (7/9), so that the deviation of the dimple sizes can be kept relatively small.

In FIGS. 11 through 14, the dimples disposed in the imaginary spherical regular polygons are sixteen, the dimples disposed in the near-equator imaginary spherical polygons are twenty, the dimples disposed in the near-pole imaginary spherical isosceles triangles are three, and the dimples disposed in the near-equator imaginary spherical isosceles triangles are six.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A golf ball comprising:

a spherical surface that is divided into a first hemisphere and a second hemisphere; and a plurality of dimples that are positioned on the spherical surface of the golf ball and arranged on the first hemisphere or the second hemisphere so that each dimple is substantially entirely disposed within a boundary of one of a plurality of imaginary spherical polygons on the spherical surface of the golf ball within the first hemisphere or the second hemisphere, wherein the plurality of dimples are arranged within a plurality of imaginary spherical polygons, wherein a border of each of the imaginary spherical polygons separates the plurality of dimples with:

sixteen dimples arranged within an imaginary spherical regular pentagon centered on a pole of the golf ball defined by line segments of five non-equatorial imaginary great circles;

three dimples arranged within each of five near-pole imaginary spherical isosceles triangles, each of the five near-pole imaginary spherical isosceles triangles sharing an edge with the imaginary spherical regular pentagon;

twenty dimples arranged within each of five near-equator imaginary spherical pentagons, each of the five near-equator imaginary spherical pentagons sharing two edges with two of the five near-pole isosceles triangles;

six dimples arranged within each of five near-equator imaginary spherical isosceles triangles, each of the five near-equator imaginary spherical isosceles triangles bordering two adjacent of the five near-equator imaginary spherical pentagons, and wherein each imaginary spherical polygon of said near-pole imaginary spherical isosceles triangle, near-equator imaginary spherical pentagon, and near-equator imaginary spherical isosceles triangle is bordered on one side by a line segment of one of said five non-equatorial imaginary great circles or said imaginary equatorial great circle and is bordered on the remaining sides by a line segment of a respective imaginary small circle that is defined by a plane that does not pass through a central point of a sphere of the golf ball.

2. The golf ball of claim 1, wherein the five non-equatorial imaginary great circles and respective imaginary small circle comprise line segments that define each of the imaginary spherical polygons, said line segments comprising:

a first imaginary parting line defined by a line segment belonging to a first imaginary small circle and connecting a Point 1 (latitude 0° and longitude 0°), a Point 11 (latitude 39° and longitude 18°), and a Point 16 (latitude 61.4° and longitude 54°), a line segment belonging to a first imaginary great circle and connecting the Point 16 (latitude 61.4° and longitude 54°), a Point 22 (latitude 66.19818538° and longitude 90°), and a Point 17 (latitude 61.4° and longitude 126°), and a line segment belonging to a second imaginary small circle and connecting the Point 17 (latitude 61.4° and longitude 126°), a Point 13 (latitude 39° and longitude 162°), and a Point 6 (latitude 0° and longitude 180°);

a second imaginary parting line obtained by combining a line segment belonging to a third imaginary small circle and connecting a Point 2 (latitude 0° and longitude 36°), the Point 11 (latitude 39° and longitude 18°), and a Point 20 (latitude 61.4° and longitude 342°), a line segment belonging to a second imaginary great circle and connecting the Point 20 (latitude 61.4° and longitude 342°), a Point 25 (latitude 66.19818538° and longitude 306°), and a Point 19 (latitude 61.4° and longitude 270°), and a line segment belonging to a fourth imaginary small circle and connecting the Point 19 (latitude 61.4° and longitude 270°), a Point 14 (latitude 39° and longitude 234°), and a Point 7 (latitude 0° and longitude 216°);

a third imaginary parting line obtained by combining a line segment belonging to a fifth imaginary small circle and connecting a Point 3 (latitude 0° and longitude 72°), a Point 12 (latitude 39° and longitude 90°), and the Point 17 (latitude 61.4° and longitude 126°), a line segment belonging to a third imaginary great circle and connecting the Point 17 (latitude 61.4° and longitude 126°), a Point 23 (latitude 66.19818538° and longitude 162°), and a Point 18 (latitude 61.4° and longitude 198°), and a line segment belonging to a sixth imaginary small circle and connecting the Point 18 (latitude 61.4° and longitude 198°), the Point 14 (latitude 39° and longitude 234°), and a Point 8 (latitude 0° and longitude 252°);

a fourth imaginary parting line obtained by combining a line segment belonging to a seventh imaginary small circle and connecting a Point 4 (latitude 0° and longitude 108°), the Point 12 (latitude 39° and longitude 90°), and the Point 16 (latitude 61.4° and longitude 54°), a line segment belonging to a fourth imaginary great circle and connecting the Point 16 (latitude 61.4° and longitude 54°), a Point 21 (latitude 66.19818538° and longitude 18°), and the Point 20 (latitude 61.4° and longitude 342°), and a line segment belonging to an eighth imaginary small circle and connecting the Point 20 (latitude 61.4° and longitude 342°), a Point 15 (latitude 39° and longitude 306°), and a Point 9 (latitude 0° and longitude 288°); and a fifth imaginary parting line obtained by combining a line segment belonging to a ninth imaginary small circle and connecting a Point 5 (latitude 0° and longitude 144°), the Point 13 (latitude 39° and longitude 162°), and the Point 18 (latitude 61.4° and longitude 198°), a line segment belonging to a fifth imaginary great circle and connecting the Point 18 (latitude 61.4° and longitude 198°), a Point 24 (latitude 66.19818538° and longitude 234°), and the Point 19 (latitude 61.4° and longitude 270°), and a line segment belonging to a tenth imaginary small circle and connecting the Point 19 (latitude 61.4° and longitude 270°), the Point 15 (latitude 39° and longitude 306°), and a Point 10 (latitude 0° and longitude 324°).

3. The golf ball of claim 1, wherein the dimples comprise one or more circular dimples.

4. The golf ball of claim 3, wherein the dimples have about two to eight dimple sizes.

5. The golf ball of claim 1, wherein the dimples comprise one or more polygonal dimples.

6. The golf ball of claim 5, wherein the dimples have about two to eight dimple sizes.

7. The golf ball of claim 1, wherein the golf ball comprises a first half and a second half joined at respective joining equators and wherein each of the first half and the second half has 30 same sized dimples adjacent to its respective joining equator, and the joining equators of the first half and the second half are joined into the golf ball so that each joining equator of them may face each other with a southern hemisphere rotated by 30 degrees in a counterclockwise direction relative to a northern hemisphere.

8. The golf ball of claim 1, wherein each half finished product has 30 same sized dimples adjacent to its equator, and the equators of two half finished products of golf ball into a golf ball is joining the two half finished products so that each equators of them may face each other with a southern hemisphere rotated by 36 degrees in a counterclockwise direction relative to a northern hemisphere.

9. The golf ball of claim 1, wherein ten of the sixteen dimples arranged within the imaginary spherical regular pentagon are intersected by a side of the imaginary spherical regular pentagon.

10. The golf ball of claim 1, wherein a border between the imaginary spherical regular pentagon and a near-pole imaginary spherical isosceles triangle of the five near-pole imaginary spherical isosceles triangles intersects three dimples arranged within the near-pole imaginary spherical regular pentagon and also intersects two dimples arranged within a near-pole imaginary spherical isosceles triangle of the five near-pole imaginary spherical isosceles triangles.

11. The golf ball of claim 1, wherein the twenty dimples arranged within a near-equator imaginary spherical pentagon of the five near-equator imaginary spherical pentagons comprise twelve dimples arranged around an inner perimeter of the near-equator imaginary spherical pentagons.

12. The golf ball of claim 1, wherein the six dimples arranged within a near-equator imaginary spherical isosceles triangle of the five near-equator imaginary spherical isosceles triangles are each intersected by at least one border of the near-equator imaginary spherical isosceles triangle.

13. A golf ball that is symmetrical with respect to an imaginary equator, the golf ball comprising:

a spherical surface divided into a first hemisphere and a second hemisphere; and a plurality of dimples that are positioned and arranged on the first hemisphere or the second hemisphere according to imaginary spherical polygons on the surface so that each dimple is substantially entirely disposed within a boundary of an imaginary spherical polygon such that a border of each imaginary spherical polygon separates the plurality of dimples, the imaginary spherical polygons including an imaginary spherical regular pentagon, five near pole imaginary spherical triangles that surround and contact the imaginary spherical regular pentagon, five near equator imaginary spherical triangles that surround and contact the imaginary equator, and five imaginary spherical pentagons, wherein the imaginary spherical polygons are definable on the surface in relation to ten reference points that are equally spaced about a circumference of the imaginary equator, wherein:

the imaginary spherical regular pentagon is centered on an imaginary pole of the golf ball and is defined by five non-equatorial great circles with each imaginary great circle passing through two reference points of said ten reference points that and are located opposite to each other, with the imaginary spherical regular pentagon having sixteen dimples arranged therein;

each of the five near pole imaginary spherical triangle shares a vertex with a near equator imaginary spherical triangle, with each of the five imaginary spherical pentagons having twenty dimples arranged therein;

each of the five spherical pentagon is bordered by the imaginary equator, two near pole imaginary spherical triangles, and two near equator imaginary spherical triangles, with each of the five near pole imaginary spherical triangles having three dimples arranged therein;

each of the five near equator imaginary spherical triangles having six dimples arranged therein; and a plurality of imaginary line segments define said five near pole imaginary spherical triangles, said five near equator imaginary spherical triangles, and said five imaginary spherical pentagons with each imaginary line segment of said plurality of imaginary line segments having end points that consist of two reference points of said ten reference points located opposite to each other and with each imaginary line segment including a combination of an imaginary line segment of two imaginary small circles and a line segment of one of said five imaginary great circles.

14. The golf ball of claim 13, wherein the plurality of imaginary line segments that define said five near pole imaginary spherical triangles, said five near imaginary equator spherical triangles, and said five imaginary spherical pentagons comprise:

a first imaginary parting line obtained by combining three line segments of a first imaginary small circle line segment connecting a Point 1 (latitude 0° and longitude 0°), a Point 11 (latitude 39° and longitude 18°), and a Point 16 (latitude 61.4° and longitude 54°), a first imaginary great circle line segment connecting the Point 16 (latitude 61.4° and longitude 54°), a Point 22 (latitude 66.19818538° and longitude 90°), and a Point 17 (latitude 61.4° and longitude) 126°, and a second imaginary small circle line segment connecting the Point 17 (latitude 61.4° and longitude 126°), a Point 13 (latitude 39° and longitude 162°), and a Point 6 (latitude 0° and longitude 180°);

a second imaginary parting line obtained by combining three line segments of a third imaginary small circle line segment connecting a Point 2 (latitude 0° and longitude 36°), the Point 11 (latitude 39° and longitude 18°), and a Point 20 (latitude 61.4° and longitude 342°), a second imaginary great circle line segment connecting the Point 20 (latitude 61.4° and longitude 342°), a Point 25 (latitude 66.19818538° and longitude 306°), and a Point 19 (latitude 61.4° and longitude 270°), and a fourth imaginary small circle line segment connecting the Point 19 (latitude 61.4° and longitude 270°), a Point 14 (latitude 39° and longitude 234°), and a Point 7 (latitude 0° and longitude 216°);

a third imaginary parting line obtained by combining three line segments of a fifth imaginary small circle line segment connecting a Point 3 (latitude 0° and longitude 72°), a Point 12 (latitude 39° and longitude 90°), and the Point 17 (latitude 61.4° and longitude 126°), a third imaginary great circle line segment connecting the Point 17 (latitude 61.4° and longitude 126°), a Point 23 (latitude 66.19818538° and longitude 162°), and a Point 18 (latitude 61.4° and longitude 198°), and a sixth imaginary small circle line segment connecting the Point 18 (latitude 61.4° and longitude 198°), the Point 14 (latitude 39° and longitude 234°), and a Point 8 (latitude 0° and longitude 252°);

a fourth imaginary parting line obtained by combining three line segments of a seventh imaginary small circle line segment connecting a Point 4 (latitude 0° and longitude) 108°, the Point 12 (latitude 39° and longitude 90°), and the Point 16 (latitude 61.4° and longitude 54°), a fourth imaginary great circle line segment connecting the Point 16 (latitude 61.4° and longitude 54°), a Point 21 (latitude 66.19818538° and longitude 18°), and a Point 20 (latitude 61.4° and longitude 342°), and an eighth imaginary small circle line segment connecting the Point 20 (latitude 61.4° and longitude 342°), a Point 15 (latitude 39° and longitude 306°), and a Point 9 (latitude 0° and longitude 288°); and a fifth imaginary parting line obtained by combining three line segments of a ninth imaginary small circle line segment connecting a Point 5 (latitude 0° and longitude 144°), the Point 13 (latitude 39° and longitude 162°), and the Point 18 (latitude 61.4° and longitude) 198°, a fifth imaginary great circle line segment connecting the Point 18 (latitude 61.4° and longitude 198°), a Point 24 (latitude 66.19818538° and longitude 234°), and the Point 19 (latitude 61.4° and longitude 270°), and a tenth imaginary small circle line segment connecting the Point 19 (latitude 61.4° and longitude 270°), the Point 15 (latitude 39° and longitude 306°), and a Point 10 (latitude 0° and longitude 324°).

15. The golf ball of claim 13, wherein the dimples comprise one or more circular dimples.

16. The golf ball of claim 15, wherein the dimples have about two to eight dimple sizes.

17. The golf ball of claim 13, wherein the dimples comprise one or more polygonal dimples.

18. The golf ball of claim 17, wherein the dimples have about two to eight dimple sizes.

19. Method of manufacturing a golf ball comprising:

manufacturing of two half finished products of golf ball, each having a shape of a hemisphere;

joining equators of the two half finished products of golf ball into a golf ball, wherein the manufacturing the two half finished product of golf ball comprises:

forming a plurality of imaginary spherical polygons, comprising:

forming an imaginary spherical regular pentagon centered on a pole of a hemispheres and is defined only by line segments of five non-equatorial imaginary great circles;

forming five near-pole imaginary spherical isosceles triangles, five near-equator imaginary spherical pentagons, and five near-equator imaginary spherical isosceles triangles, wherein each imaginary spherical polygon of said near-pole imaginary spherical isosceles triangle, near-equator imaginary spherical pentagon, and near-equator imaginary spherical isosceles triangle is bordered on one side by a line segment of one of said five non-equatorial imaginary great circles or said imaginary equatorial great circle and is bordered on the remaining sides by a line segment of a respective imaginary small circle that is defined by a plane that does not pass through a central point of a sphere of the golf ball, with:

each of the five near-pole imaginary spherical isosceles triangles sharing an edge with the imaginary spherical regular pentagon;

each of the five near-equator imaginary spherical pentagons sharing two edges with two of the five near-pole imaginary isosceles triangles; and each of the five near-equator imaginary spherical isosceles triangles bordering two adjacent of the five near-equator imaginary spherical pentagons; and positioning a plurality of dimples on the two half finished products of golf ball so that each dimple is substantially entirely disposed within a boundary of one of the plurality of imaginary spherical polygons, wherein a border of each of the imaginary spherical polygons separate the plurality of dimples, on the surface of each of the two half finished products of golf ball with:

sixteen dimples arranged within the imaginary spherical regular pentagon;

three dimples arranged within each of the five near-pole imaginary spherical isosceles triangles;

twenty dimples arranged within each of the five near-equator imaginary spherical pentagons; and six dimples arranged within each of the five near-equator imaginary spherical isosceles triangles.

* * * * *